US010753692B1

(12) United States Patent
Thompson

(10) Patent No.: US 10,753,692 B1
(45) Date of Patent: Aug. 25, 2020

(54) HYBRID GAS-PISTON RIFLE AND BARREL NUT

(71) Applicant: Robert B. Thompson, Miami, FL (US)

(72) Inventor: Robert B. Thompson, Miami, FL (US)

( * ) Notice: Subject to any disclaimer, the term of this patent is extended or adjusted under 35 U.S.C. 154(b) by 0 days.

(21) Appl. No.: 16/287,725

(22) Filed: Feb. 27, 2019

(51) Int. Cl.
*F41A 5/26* (2006.01)

(52) U.S. Cl.
CPC ..... *F41A 5/26* (2013.01)

(58) Field of Classification Search
CPC ..... F41A 5/18; F41A 5/20; F41A 5/22; F41A 5/26; F41A 5/28
USPC ..... 89/191.01, 191.02, 192
See application file for complete search history.

(56) References Cited

U.S. PATENT DOCUMENTS 2,865,256 A * 12/1958 Marsh ..... F41A 3/62 89/191.02
2,951,424 A 9/1960 Stoner
3,455,204 A 7/1969 Stoner
3,592,101 A 7/1971 Vartanian
4,475,438 A 10/1984 Sullivan
4,765,224 A 8/1988 Morris
5,351,598 A 10/1994 Schuetz
5,448,940 A 9/1995 Schuetz
5,499,569 A 3/1996 Schuetz
7,461,581 B2 12/2008 Leitner-Wise
7,832,326 B1 11/2010 Barrett
8,210,089 B2 7/2012 Brown
8,539,708 B2 9/2013 Kenney
9,506,711 B2 11/2016 Gomez
9,766,027 B1 9/2017 Cavanaugh
9,816,546 B2 11/2017 Gomez
2002/0073832 A1* 6/2002 Vignaroli ..... F41A 5/18 89/191.01
2017/0284760 A1* 10/2017 Maffett ..... F41A 21/484
2019/0226776 A1* 7/2019 DiChario ..... F41A 3/26

* cited by examiner

*Primary Examiner* — Bret Hayes
(74) *Attorney, Agent, or Firm* — Michael M. McGaw; McGaw Law, P.C.

(57) ABSTRACT

An improved gas piston system for the automatic loading of a rifle, especially a rifle of the M-16/AR-15 type. The system employs a nut, or an adaptor to a barrel nut, that has been modified to secure one end of a gas piston system. The other end of the gas piston system, namely the piston rod, engages, either directly or indirectly, the key on a bolt carrier group. This configuration positions the gas piston system at a point starting near the barrel nut and extending to the bolt carrier group of the rifle, while a gas tube extends from the gas block to the gas piston system a point near the barrel nut.

21 Claims, 27 Drawing Sheets

HYBRID GAS-PISTON RIFLE AND BARREL NUT

FIELD OF INVENTION

This invention relates to firearms. More specifically, this invention relates to the loading mechanism for self-loading firearms.

BACKGROUND OF THE INVENTION

The M16 rifle, and its civilian counterpart the AR-15, was originally developed by American engineer Eugene Stoner of ArmaLite Inc. in the late 1950s. The rifle was notable for its light weight, its accuracy, and its relative capacity to fire large amounts of ammunition. The Stoner auto loading design was the subject of U.S. Pat. No. 2,951,424, which issued to E. M. Stoner on Sep. 6, 1960. Specifically, the '424 patent discloses the M16 bolt and bolt carrier system and the gas operation thereof. The system utilizes a gas tube that extends from a gas port in the barrel, back into the upper receiver of the rifle and into a gas tube pocket or "key" attached to the bolt carrier. The original Stoner design is frequently referred to as a "gas impingement" or "direct impingement" system.

Direct impingement or gas impingement is a type of gas operation for a firearm designed to expel a spent cartridge and load a new cartridge using the gas that is discharged from a cartridge as it trails a bullet down the barrel of a rifle. In a gas impingement system, the gas from firing a cartridge is directed down the barrel of a rifle and enters a gas tube at or toward the distal end of the barrel. The gas tube forms a conduit through which the gas is propelled back to the bolt carrier or slide assembly to cycle the action in the firearm. More specifically, in a direct gas impingement system, when the firearm is fired, the exhaust propellant gases from the fired cartridge are directed through a port at the end of the barrel and then channeled back to the bolt carrier and will strike, or impinge, the bolt carrier moving it rearward toward the buttstock and into a retracted position. The exhaust gases will then discharge out the exhaust on the bolt carrier group or the ejection port on the side of the firearm near the buttstock. After discharge, the buffer tube spring, acting on the bolt carrier, will move the bolt carrier back to the engaged position, while simultaneously stripping and picking up another cartridge from the magazine and moving that cartridge into a battery position within the firearm's breech. Examples of direct gas impingement firearms include the AR-15, M4, AR-10, and M16 style firearms.

The conventional AR-15/M-16 gas-operated direct impingement system has been observed to have a number of short-comings. The principal shortcoming of this system is the deposits of residues that accumulate in the bolt from discharge gasses. The deposits decrease the reliability and usability of the rifle. Deposits inhibit the proper operation of the firearm, requiring frequent cleaning of the gas operating system. The discharge of gases into the bolt also creates excessive heat in the bolt and break down lubrication that normally enables the smooth operation of the bolt assembly. Additionally, performing the cleaning of the rifle bolt assembly under field conditions is difficult and requires specialized tools, which may not be available.

The original direct impingement system has been modified or replaced with a gas piston system in an effort to overcome some of the aforementioned shortcomings. Many of the designs are retrofit systems that entirely replace the gas tube with a piston and cylinder. In these systems, the piston head and cylinder are mounted to the gas block towards the distal end of the barrel. Discharge gasses flow out of the barrel and into the piston chamber where the gasses force the piston back towards the bolt carrier, driving the bolt carrier back toward the buttstock and into a retracted position. The exhaust gases can then discharge out from the firearm near the gas block. Like the gas impingement system, after discharge, the buffer tube spring acting on the bolt carrier will move the bolt carrier back to the engaged position, while simultaneously stripping or picking up another cartridge from the magazine and moving that cartridge into a battery position within the firearm's breech.

Because the gasses vent out of the firearm near the barrel, firearms using a gas piston system do not deposit as much residue in the bolt carrier assembly. They also do not heat up as much around the bolt carrier assembly. This enables rifles using a gas piston system to require less frequent maintenance. They also operate cooler in situations where large amounts of ammunition is fired over a short period of time. However, gas piston systems have their own drawbacks. First, rifles using gas piston systems are heavier than otherwise identical rifles using direct impingement systems. To compound the problem, the additional weight of the gas piston system is localized towards the barrel of the rifle, which can impair the maneuverability of the rifle in field situations. Second, rifles with gas piston systems have proven to be less accurate than otherwise identical direct impingement rifles. This may occur because the gas piston system reduces or eliminates the ability of the barrel to float, leading to diminished harmonics. Lastly, many gas piston systems have designs that render them difficult, or impossible, to service in the field. While these rifles generally require less service, they still must be serviced occasionally. Malfunctions also need to be addressed or cleared when they arise with the piston system. These malfunctions can occur due to the deposition of residues that will contact the piston system.

It would be highly advantageous, therefore, to remedy the foregoing and other deficiencies inherent in the previous direct impingement and gas piston systems. However, in view of the art considered as a whole at the time the present invention was made, it was not obvious to those of ordinary skill in the field of this invention how the shortcomings of the prior art could be overcome.

SUMMARY OF THE INVENTION

The long-standing but heretofore unfulfilled need for is now met by a new, useful, and nonobvious hybrid gas-piston system and barrel nut.

In a first aspect the present invention provides a gas piston assembly. The gas piston assembly includes a barrel nut having a substantially hollow generally cylindrical shape with an external surface and an internal surface. The internal surface of the barrel nut has an engagement member configured to securely engage a receiver of a firearm. The engagement member could be threads that are complementary to threads on the receiver of a rifle. The barrel nut also has piston mount on the external surface of the barrel nut. The gas piston assembly also includes a gas piston unit having a first piston chamber component that is integral or affixed to the piston mount, a second piston chamber component removeably affixed to the first gas piston chamber, and a piston. The piston has a piston head in the chamber formed by the first and second piston components and a piston rod that engages a bolt carrier key of a bolt carrier group. The gas piston assembly further includes a gas tube in communication with a rifle barrel gas port at a first end of the gas tube and the gas piston chamber at a second end of the gas tube.

In an advantageous embodiment the piston mount on the external surface of the barrel nut is distal to the engagement member. Having the piston mount at a distal point to the engagement member (e.g. barrel nut threads) allows the system to achieve the proper geometry for the piston rod to engage the key on the bolt carrier group. In still further advantageous embodiments, the piston mount and the engagement member are threaded. The threads of the piston mount are distal to the threads on the engagement member. Again, this facilitates the proper geometry for the piston rod.

The second piston chamber can be removeably affixed to the first piston chamber piston chamber with a set of complementary threads. This facilitates access to the inner portion, or inside, of the piston chamber for cleaning of the piston chamber and the piston head inside the chamber. The second piston chamber can include a flattened or structured surface configured to be engaged by a wrench to facilitate the disengagement of the second piston chamber from the first piston chamber. In a similar manner, the second piston chamber can include a slot or channel configured to be engaged by a knife or screwdriver to facilitate the disengagement of the second piston chamber from the first piston chamber.

The second piston chamber can receive the gas tube through an aperture in the second piston chamber. Disengaging the second piston chamber from the first piston chambers can then allow the second piston chamber to slide up the gas tube towards the first end of the gas tube. This allows a user to access the inside of the gas chamber and the piston assembly for operations such as cleaning.

Either the first piston chamber component or the second piston chamber component can include an exhaust port positioned within the chamber to allow exhaust gases to escape the chamber as the piston head is forced past the exhaust port by the exhaust gases.

The first piston chamber component can have a chamber floor and there can be a piston spring on the piston rod between the piston head and the chamber floor. This configuration with the piston spring prevents the piston head from contacting the chamber floor when the piston head is forced back by the exhaust gases.

In an advantageous embodiment the gas piston assembly can include a piston chamber lock that prevents the disengagement of the first piston chamber component from the piston mount during operation. The piston chamber lock can be a sliding bolt lock.

In further advantageous embodiments the first piston chamber component can be removeably affixed to the piston mount with a set of complementary threads.

In a second aspect the present invention provides a second gas piston assembly. The gas piston assembly of the second aspect includes a barrel nut having a substantially hollow generally cylindrical shape with an external surface and an internal surface. The internal surface has an engagement member configured to securely engage a receiver of a firearm. The barrel nut also has a piston mount on the external surface of the barrel nut. The gas piston assembly also includes a gas piston unit having a gas piston chamber at a first end with a piston rod extending from the chamber to a second end. The gas piston chamber, or a portion thereof, is affixed (e.g. removeably affixed, permanently affixed or integral) to the piston mount of the barrel nut and the piston rod is configured to engage a bolt carrier key at the second end. The gas piston assembly further includes a gas tube in communication with a rifle barrel gas port at a first end of the tube and the gas piston chamber at a second end of the gas tube. The gas tube can be affixed to the gas block at the first end of the gas tube. The piston mount can be integral to the barrel nut or it can be removeably affixed to the barrel nut, such as by a piston mount adapter. The piston mount can have a bore or aperture through which the piston rod travels during operation.

In an advantageous embodiment the gas piston assembly includes a release to disengage the gas piston assembly from the piston mount of the barrel nut. The release prevents the gas piston assembly from disengaging from the barrel nut during use.

In a third aspect the present invention provides a third gas piston assembly. The gas piston assembly of the third aspect includes a piston mount adapter having a piston mount and a barrel nut engagement member. The piston mount adapter securely affixes to the barrel nut of a rifle. The gas piston assembly of the third aspect has a gas piston unit having a gas piston chamber at a first end with a piston rod extending from the chamber to a second end. The gas piston unit affixes at the gas piston chamber to the piston mount of the piston mount adapter. The piston rod of the gas piston unit is configured to engage a bolt carrier key at the second end. The gas piston assembly of the third aspect further includes a gas tube in communication with a rifle barrel gas port at a first end of the tube and the gas piston chamber at a second end of the gas tube. The piston mount adapter can be configured to securely affix to the barrel nut of the rifle distal to the threads of the barrel nut. The piston mount adapter can be cylindrical in shape with a circumferential channel configured to receive the index of a barrel nut.

In a fourth aspect the present invention provides a barrel nut. The barrel nut can have a barrel nut body having a substantially hollow generally cylindrical shape with an internal surface with an engagement member configured to securely engage a receiver of a rifle and an external surface. The hollow cylindrical shape defines a generally longitudinally extending bore extending from a back end of the nut along a longitudinal axis to a front end of the nut. The barrel nut can also have a piston mount on the external surface of the barrel nut body. The piston mount can have a generally longitudinally extending bore extending from a back end of the mount along a longitudinal axis to the front end of the mount and parallel to the barrel nut body bore. The piston mount has a piston mount engagement member adapted to secure a piston chamber of a gas piston system. The piston mount can be integral to the barrel nut body. The piston mount engagement member can have a set of threads configured to engage complementary threads on a piston chamber of a gas piston system.

In an advantageous embodiment the piston mount has a piston chamber lock to prevent the disengagement of a gas piston chamber from the piston mount during operation.

The piston mount on the external surface of the barrel nut can be distal to the engagement member. The piston mount and the engagement member can be threaded and the threads of the piston mount can be distal to the threads on the engagement member when the barrel nut is mounted on a rifle.

In a fifth aspect the present invention provides a second barrel nut. The barrel nut of the second aspect can have a barrel nut body having a substantially hollow generally cylindrical shape with an external surface and an internal surface with an engagement member configured to securely engage a receiver of a rifle. The hollow cylindrical shape defines a generally longitudinally extending bore extending from a back end of the nut along a longitudinal axis to a front end of the nut. The barrel nut can also have a piston mount on the external surface of the barrel nut body. The piston mount has an attachment member configured to removeably secure a gas piston chamber to the barrel nut body. The piston mount can have a piston release component to disengage the gas piston chamber from the piston mount.

In certain embodiments the piston mount is integral to the barrel nut body. The piston mount on the external surface of the barrel nut can be distal to the engagement member on the internal surface of the barrel nut when the barrel nut is mounted on a rifle. In an advantageous embodiment the piston mount and the engagement member are threaded and the threads of the piston mount are distal to the threads on the engagement member.

In a sixth aspect the present invention provides a piston mount adapter. The piston mount adapter can have a piston mount adapter body having a substantially hollow generally cylindrical shape with an internal surface with an engagement member configured to securely engage a barrel nut of a rifle and an external surface. The hollow cylindrical shape defines a generally longitudinally extending bore extending from a back end of the piston mount adapter body along a longitudinal axis to a front end of the piston mount adapter body. The piston mount adapter can also have a piston mount on the external surface of the piston mount adapter body. The piston mount can have a generally longitudinally extending bore extending from a back end of the mount along a longitudinal axis to a front end of the mount and parallel to the piston mount adapter body bore. The piston mount has a piston mount engagement member adapted to secure a piston chamber of a gas piston system. The piston mount on the external surface of the piston mount adapter can be distal to the engagement member on the internal surface of the adapter. The piston mount and the engagement member can be threaded and the threads of the piston mount can be distal to the threads on the engagement member when the adapter is mounted on the barrel nut of a rifle.

In an advantageous embodiment the inner surface of the piston mount adapter has a circumferential channel configured to receive the index of a barrel nut.

BRIEF DESCRIPTION OF THE DRAWINGS

For a fuller understanding of the invention, reference should be made to the following detailed description, taken in connection with the accompanying drawings, in which:

FIG. 2 shows the rifle of FIG. 1 with the handguard removed to expose the hybrid gas piston system underneath the handguard.

FIG. 13 is a side elevation ghost view of an embodiment of a barrel nut as shown in

FIG. 11.

DETAILED DESCRIPTION OF THE PREFERRED EMBODIMENT

Figure 1:
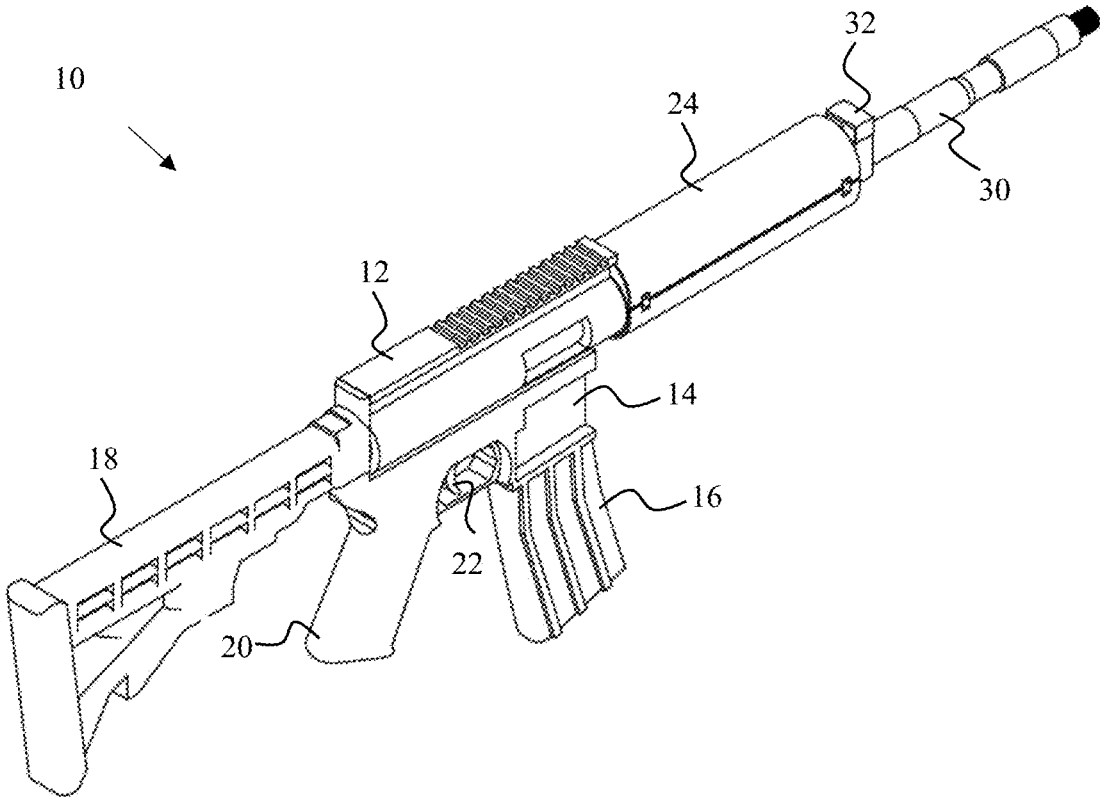
FIG. 1 is a perspective view of an AR-15-type rifle with a handguard.

An improved gas piston system for the automatic loading of a rifle, especially a rifle of the M-16/AR-15 type, is disclosed herein. The system employs a barrel nut or piston mount adapter that has been modified to secure one end of a gas piston system. The other end of the gas piston system, namely the piston rod, engages, either directly or indirectly, the key on a bolt carrier group. This configuration positions the gas piston system at a point starting near the barrel nut and extending to the bolt carrier group of the rifle, while a gas tube extends from the gas block to the gas piston system at a point near the barrel nut. This localizes the weight of the gas piston system roughly within the region of the upper receiver of the rifle. The system according to the invention uses a gas tube to direct gas out from the barrel and gas block and back along a path parallel to the rifle barrel to the gas piston system starting at the barrel nut, where the gas tube terminates at the chamber for the gas piston system. Exhaust gasses are ported out of the piston chamber as the exhaust gases drive the piston assembly back against the key on the bolt carrier group. This effects a cycling of the bolt carrier resulting in a spent cartridge being ejected and a live cartridge being loaded.

Rifles of the invention are a significant improvement over rifles using both direct impingement systems and gas piston systems. Rifles according to the invention rectify many of the problems associated with both of those designs. The exhaust gases used to provide the energy for automatic reloading do not heat up the bolt carrier group or leave the deposits associated with direct impingement rifles because the gases are exhausted from the rifle at a point away from the bolt carrier group. Lubrication applied to components in the region of the bolt carrier group break down at a much slower rate because the rifle heats up less in the area of the bolt carrier group. Rifles of the invention achieve significantly less deposits in the bolt carrier group. As a result, rifles according to the invention can operate significantly longer between service intervals when compared to rifles using a direct impingement system.

Many of the gas piston system designs affix one end of the piston system to the gas block towards the far end of the barrel and the other end of the piston system, namely the piston rod, contacts the bolt carrier key. This arrangement has the effect of reducing or eliminating the float of the barrel, which creates a rifle with measurably reduced accuracy when compared to an otherwise identical direct impingement system rifle. Rifles of the invention do not attach the piston assembly to the gas block. Instead, one end of the piston system is anchored to the barrel nut, which is generally firmly affixed to the upper receiver of the rifle. As such, the piston assembly does not influence the float of the barrel. The other end of the piston system contacts the key of the bolt carrier. The region of the rifle between the barrel nut and the gas block employs a gas tube. By virtue of this configuration, rifles according to the invention are able to exhibit significantly greater accuracy than otherwise identical gas piston system-equipped rifles and perform, from an accuracy standpoint, like a direct impingement system rifle. In addition, rifles according to the invention tend to be lighter than otherwise identical gas piston system-equipped rifles and have less weight distributed towards the barrel. The better weight distribution results in a rifle that is easier to maneuver in the field and less fatiguing to the user.

In a rifle utilizing a hybrid gas piston system according to the invention, when the firearm is fired, the exhaust propellant gases from the fired cartridge are directed through a port at the end of the barrel and into the gas block. At the gas block, the exhaust gases are channeled back towards the barrel nut of the rifle via a gas tube. The gas tube carries the gases back into a two-piece piston chamber assembly mounted on the piston mount of the barrel nut. Once in the piston chamber, the gases drive a piston back towards the bolt carrier, moving the bolt carrier rearward toward the buttstock and into a retracted position. The exhaust gases can then discharge out exhaust ports in the piston chamber assembly. After discharge, the buffer tube spring, acting on the bolt carrier, will move the bolt carrier back to the engaged position, while simultaneously stripping and picking up another cartridge from the magazine and moving that cartridge into a battery position within the firearm's breech.

The buffer tube spring also provides the force necessary to return the piston to its ready position in the piston chamber.

Rifles according to the invention can also have autoloading systems that can be broken down and quickly cleaned and reassembled in the field. In a preferred embodiment, rifles according to the invention have a two-piece piston chamber assembly. A first piece of the two-piece piston chamber assembly, referred to below as the "barrel piston cylinder", threads into a piston mount that is integral to the barrel nut, or otherwise attached to the barrel nut. The second piece of the two-piece piston chamber assembly, referred to as the "piston cap", threads into the first piece, or barrel piston cylinder, forming a chamber with a piston head inside the chamber. A piston rod extends from the piston head and out of an opening on the barrel piston cylinder of the two-piece piston chamber assembly. A gas tube terminates in an opening of the barrel piston cap of the two-piece piston chamber assembly. A user can unscrew the barrel piston cap of the two-piece piston chamber assembly from the barrel piston cylinder and slide the barrel piston cap up the gas tube to access the piston within the piston chamber. The piston and the inside of the piston chamber can then be quickly cleaned. Once cleaned, the piston head can be returned to the chamber and the second piece of the two-piece piston chamber assembly can be securely threaded back onto the first piece. The entire operation can be performed with simple tools, such as the end of a knife, to engage the second piece of the piston chamber (i.e. the barrel piston cap) while unscrewing from the first piece (i.e. the barrel piston cylinder). A cloth can then be used to remove deposits from within the exposed chamber and piston head.

Referring now to FIG. 1, there is shown a perspective view of an M16/AR-15 type rifle 10 with a handguard 24. M16/AR-15 type rifles employ a design where the barrel 30 of the rifle is affixed to the upper receiver 12 using a barrel nut (not shown in FIG. 1). A handguard is mounted over the proximal end of the barrel between the upper receiver and the gas block 32. The handguard protects a user's hand from the barrel of the rifle, which can heat up significantly during use.

The rifle of FIG. 1 has an upper receiver 12, which houses the bolt carrier group of the rifle. The lower receiver 14 is joined to the upper receiver 12. The barrel 30 of the rifle is affixed to the upper receiver 12 with the barrel nut 60 (not shown in FIG. 1). The buttstock 18, housing a buffer tube spring, is affixed to the lower receiver 14. The rifle also includes a grip 20 to be grasped by the hand of a user, a trigger 22 to fire the rifle, a magazine 16 to hold cartridges, and a gas block 32 to port exhaust gases out of the barrel 30 of the rifle.

Figure 2:
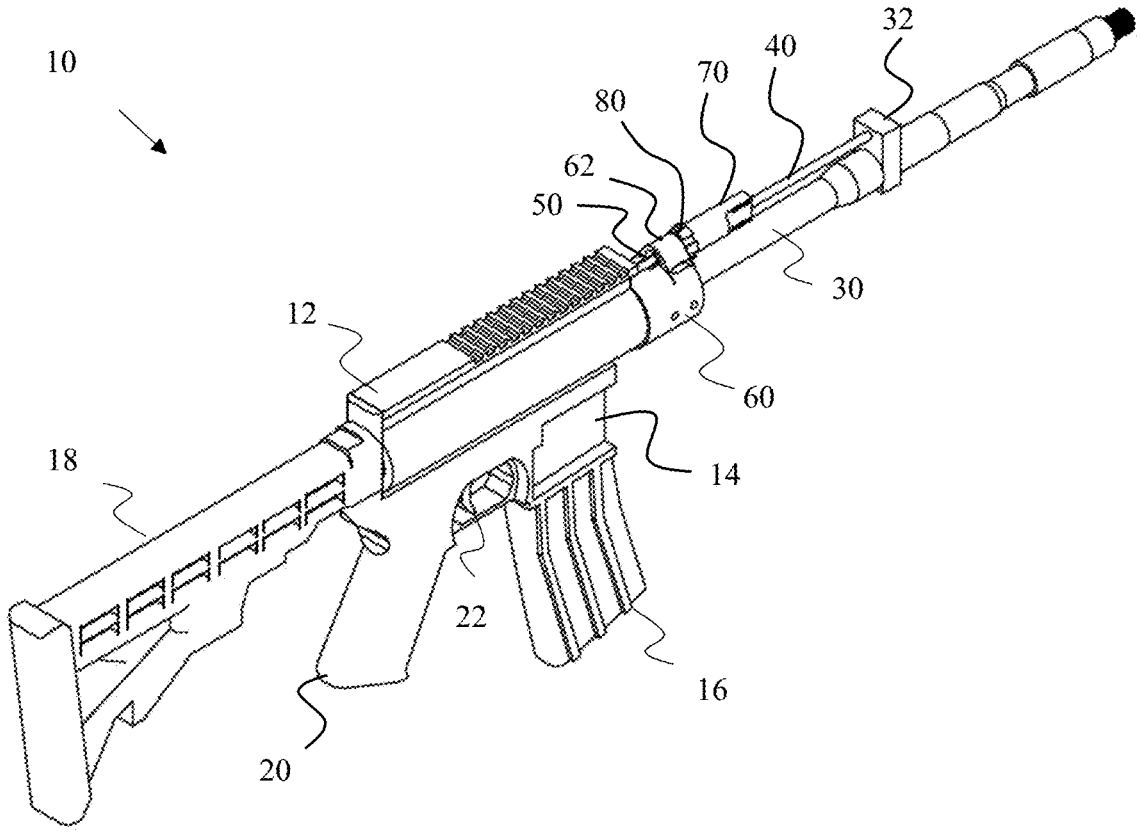
FIG. 2 is a perspective view of an embodiment of a rifle according to the invention.

Turning to FIG. 2, there is shown a perspective view of an M16/AR-15-type rifle 10 of FIG. 1 with the handguard removed and having a hybrid gas piston system according to the invention. The rifle 10 consists of an upper receiver 12 attached to a lower receiver 14. The rifle 10 has a barrel 30 affixed to the upper receiver 12 with a barrel nut 60. Barrel nut 60 has a piston mount 62 with a bore through the mount, where the bore is substantially parallel to the barrel 30. Barrel 30 has a gas block 32 with a port (not shown) passing through the top portion of the barrel 30 to a bore in the gas block 32 to communicate with a gas tube 40 lying above and substantially parallel to the barrel 30. The gas tube 40 is affixed with a pin at a first end to the gas block 32 and slindingly received at a second end within the barrel piston cap 70. The barrel piston cap 70 receives gas tube 40 at the distal end (i.e. distal relative to the buttstock of the rifle or a user when firing the rifle) of the cap 70 and threadingly receives a barrel piston cylinder 80 at the proximal end of the cap 70. The gas tube 40 has a slight flare at the end of the tube where the gas tube inserts within the cap 70 to ensure a snug fit and reduce the amount of gas that can escape from the junction between the gas tube and the barrel piston cap. Barrel piston cylinder 80 is secured, such as by threading, within a bore through the piston mount 62 in the barrel nut 60. The rifle 10 includes a piston assembly 50 having a distal end secured within the piston chamber 88 of barrel piston cylinder 80 (not shown—see FIG. 10). The piston 50 has a rod 52 that passes through an aperture 86 (see FIG. 21) in the barrel piston cylinder 80. The piston 50 includes a piston spring 56 (see FIGS. 10 and 25) that contacts piston chamber wall 89 and piston head 54. Exhaust gas traveling down the gas tube 40 and into the piston chamber forces the piston back within the chamber until the piston head 54 passes gas venting ports 87 in the barrel piston cylinder 80. The gas venting ports 87 allow the exhaust gases to escape, which diminishes the force on the piston head (see e.g. FIG. 6). The buffer tube spring in the buttstock absorbs the energy from the piston 50 and then recoils back to pick up a cartridge and return the bolt to battery. The piston spring 56 contacts the piston chamber wall 89 (See FIGS. 10 and 23). The piston spring 56 prevents the piston head 54 from bottoming out in the piston chamber and slamming into the piston chamber wall 89 during compression/cycling of the piston.

Figure 3:
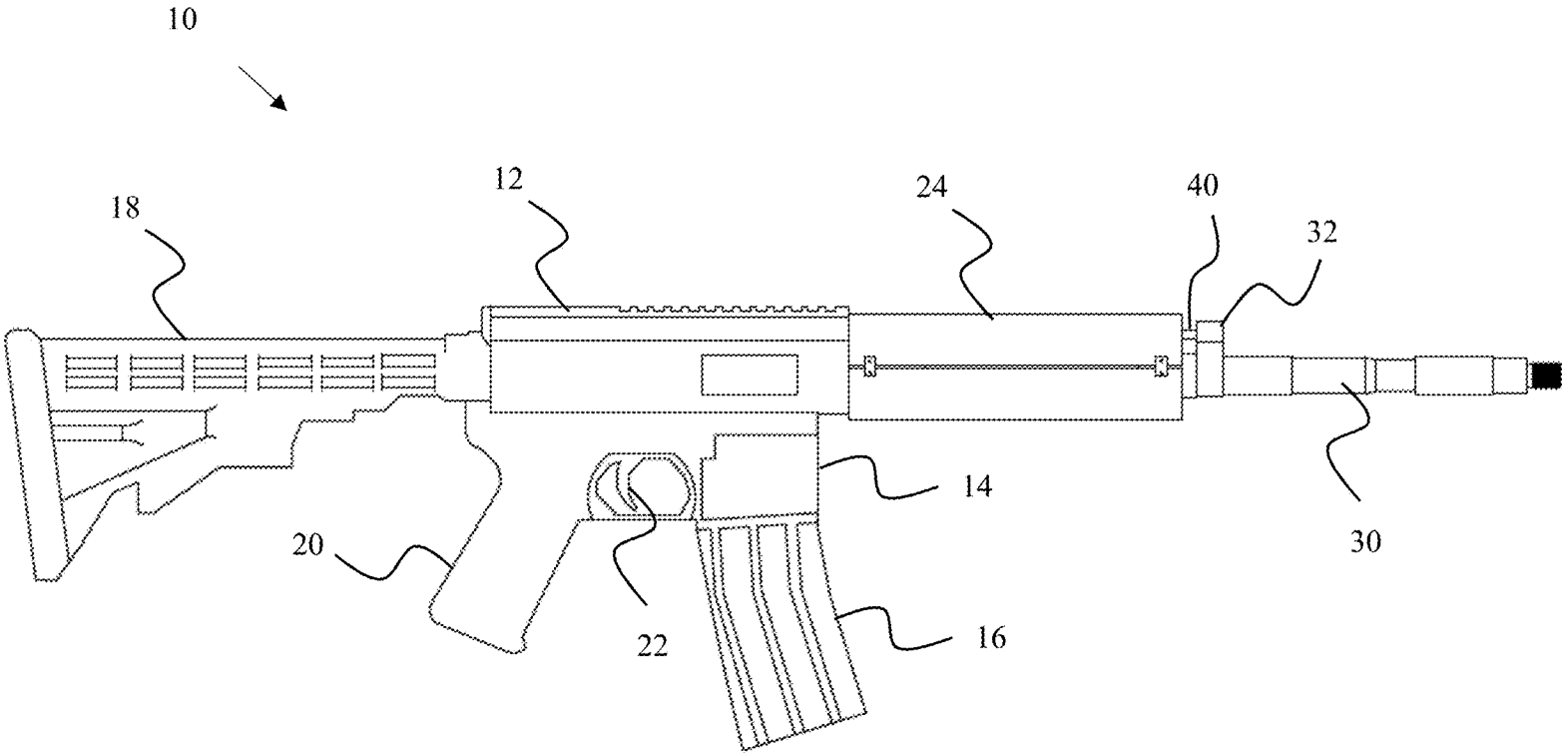
FIG. 3 is a side elevation view of the rifle shown in FIG. 1.

FIG. 3 shows a side elevation view of the rifle shown in FIG. 1. The gas tube 40 can be seen between the handguard 24 and the gas block 32.

Figure 4:
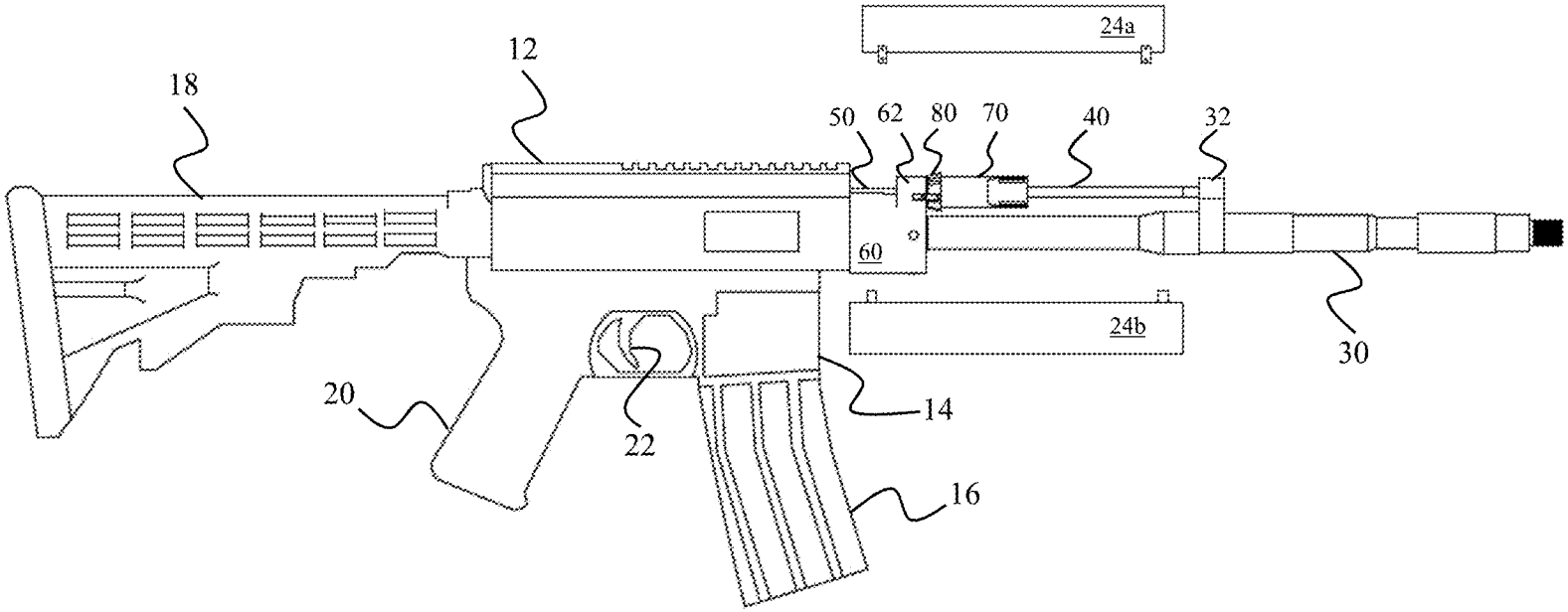
FIG. 4 is a side elevation view of the rifle shown in FIG. 3 with the handguard removed to expose the hybrid gas piston system underneath the handguard.

FIG. 4 shows a side elevation view of the rifle shown in FIG. 2. FIG. 4 shows the upper and lower elements, 24*a* and 24*b*, respectively, of the handguard 24 in proximity to the barrel 30.

Figure 5:
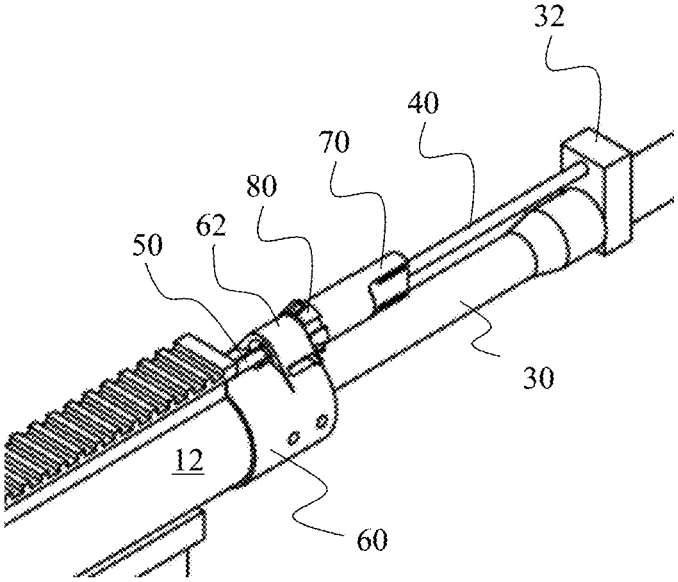
FIG. 5 is a perspective view of the barrel nut assembly components of the rifle shown in FIG. 2.

FIG. 5 shows a closeup of the barrel nut 60 with the piston mount 62 and the barrel piston components. The barrel nut 60 has a threaded longitudinal bore 61 (See e.g. FIG. 11) with a partially threaded inner surface 63 (See e.g. FIG. 12). The rear end 60*b* (See e.g. FIG. 11) of the barrel nut 60 receives and secures the rear or chamber end of a barrel 30, while the front end 60*a* of the barrel nut 60 is designed to be threadedly secured to the receiver 12 of the rifle.

Barrel nut 60 has an integral piston mount 62 on its superior aspect. The piston mount 62 has an aperture 64 or bore (see FIGS. 10 and 11) that is generally parallel with the axis of the barrel of a rifle. The inner surface of the aperture 64 can be threaded (see FIG. 12) to engage complementary threads on the barrel piston cylinder 80. The piston mount 62 is designed to sit directly above the barrel of the rifle (e.g. at 12'oclock), and distal to the threads 63 of the barrel nut, when properly mounted to an upper receiver. This ensures that the aperture 64 of piston mount 62 is in the proper position to receive the components of the gas-piston system. It has been found that threads of the piston mount 62*a* should not be positioned directly above the threads of the barrel nut 63 (i.e. the threads that mount the barrel nut to the upper receiver). The aperture 64 of piston mount 62 must be of sufficient size to receive the threaded barrel piston cylinder 80. In addition, the centerline of the aperture 64 must be in line with the point of contact for the piston rod 52 on the bolt carrier key. If the aperture 64 of piston mount 62 is sufficiently sized and located above the threads of the barrel nut 63, then the threads of the piston mount would encroach the threads of the barrel nut 63 (See e.g. FIG. 35). Therefore, the threads of the piston mount 62*a* should positioned at a point distal to the threads of the barrel nut 63. More generally, the piston mount 62 should be positioned at a distal point on the outside surface of the barrel nut to ensure sufficient size of the aperture 64 and clearance of the piston mount components. In addition, the proximal end of the rifle barrel tapers inward. This allows the inner surface of the barrel nut to have a smaller diameter its distal end, making the barrel nut thicker at the distal end. This provides additional thickness to support the threads and other modification needed for the piston mount on the barrel nut. So, for example, the piston mount could be positioned on the distal half of the barrel nut outer surface (to the extent that the barrel nut threads are on the proximal portion or half of the inner surface of the barrel nut) or the piston mount could simply be positioned distal to the threads of the barrel nut depending upon the length that the threads 63 extend across the inner surface of the barrel nut 60.

The barrel nut threads onto the upper receiver of the rifle and must be attached within a specified torque range. Failure to properly align the piston mount when threading the barrel nut onto the upper receiver can impact the performance of the gas-piston system. Minor discrepancies in alignment of the piston mount can often be resolved by inserting thin spacers between the barrel nut 60 and the receiver 12 of the rifle. The piston mount 62 serves as an anchor for the distal end of a piston assembly in a hybrid gas impingement-piston system. By using the barrel nut as an anchor for the piston, as opposed to anchoring the piston to the barrel of the rifle, the barrel of the rifle can achieve a greater degree of "float", which is believed to increase the accuracy of the rifle. In addition, the heavier piston assembly (as compared to a gas impingement system) is moved towards the center of the rifle, making the rifle better balanced and less unwieldy to maneuver and fire. The piston chamber assembly (i.e. elements 70, the barrel piston cap, and 80, barrel piston cylinder) are shown as being on the distal side of the piston mount 62 (i.e. distal relative to the buttstock). It is contemplated that the piston assembly could be re-worked to allow the assembly to be mounted on the proximal side of the barrel nut flange, although this can be far less optimal for reasons mentioned elsewhere in the present disclosure.

Figure 6:
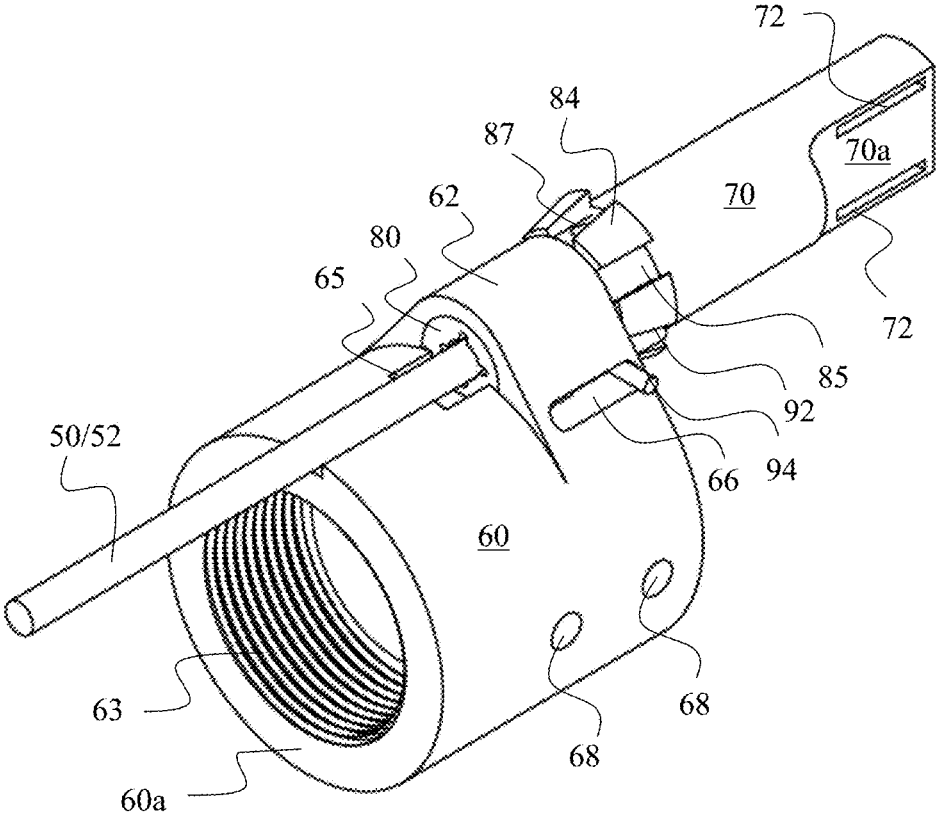
FIG. 6 is a perspective view of the barrel nut assembly components with a piston, barrel piston cylinder and barrel piston cap installed in the piston mount aperture of the barrel nut.

FIG. 6 shows a barrel nut 60 with a piston assembly 50 mounted on the piston mount 62 of the barrel nut. Barrel nut 60 has a set of holes 68 positioned to facilitate the mounting of a handguard to the rifle. The barrel nut 60 with has a set of threads 63 that engage complementary threads on the upper receiver of a rifle.

The barrel piston assembly includes a piston 50, barrel piston cylinder 80 and a barrel piston cap 70. A first end (proximal end) of barrel piston cylinder 80 is inserted into the aperture 64 (see FIG. 8) of piston mount 62. Insertion of barrel piston cylinder 80 into the aperture 64 of piston mount 62 is limited by barrel cylinder castle 84. The barrel cylinder castle 84 is angled to facilitate clearance of the proximal end of the rifle barrel, which has an inward taper moving distally from the proximal end of the rifle barrel. A second end (distal end) of barrel piston cylinder 80 is inserted into, and threadingly engages complimentary threads, within barrel piston cap 70. The piston operating rod 52 of the barrel piston assembly 50 extends through an aperture 86 (see FIG. 21) in barrel piston cylinder 80. Piston mount 62 has piston slots 65 and 69 cut along the axis of the barrel piston assembly 50 to allow for proper alignment and clearance of the piston operating rod 52.

An actuator 94 on the spring-loaded piston lock 90 (see e.g. FIG. 26) is inserted through the piston lock slot 66, with the piston lock slot 66 defining the fore-aft motion of the piston lock 90. Piston lock pin 92 sits within a castle slot 85 in the barrel cylinder castle 84, thus preventing rotation of the barrel piston cylinder 80 during operation of the rifle, which serves to lock the barrel piston cylinder 80 in the piston mount 62. Following the removal of the barrel piston cap 70 and the piston 50 from the barrel piston cylinder 80, the barrel piston cylinder 80 can be removed from the piston mount 62 by first disengaging the piston pin 92 from the castle slot 85. The piston pin 92 can be disengaged by pulling actuator 94 towards the receiver of the rifle. Once unlocked, the barrel piston cylinder 80 can be unscrewed from the piston mount 62 using a spanner wrench engaging the castle slots 85 of the barrel cylinder castle 84. It will generally not be necessary to remove the barrel piston cylinder 80 from the piston mount 62 in the field to service and clean the piston assembly. Simply removing the barrel piston cap 70 and piston 50 will be all that is required to access the piston chamber and clean the piston assembly.

The barrel piston cap 70 has a pair of barrel piston adapter slots 72 designed to receive the end of a flat article such as a screw driver. Insertion of an article within the slots 72 facilitates rotation of the barrel piston cap 70 using the additional leverage applied with the article, which can have the benefit of disengaging the barrel piston cap 70 from the barrel piston cylinder 80, such as when breaking down of the piston assembly for cleaning. Alternatively, a wrench can engage the flattened surfaces 70*a* on opposing sides of the barrel piston cap 70 to disengage the barrel piston cap 70 from the barrel piston cylinder 80. In this manner, the rifle does not require specialized tools to breakdown and clean the piston assembly. In addition, deposits are kept away from the critical components including the bolt and bolt carrier assembly. This is particularly important in the field where access to tools is limited and stress can significantly impact a user's ability to service the rifle. Furthermore, the manner in which the piston components fit together makes their assembly and disassembly less complicated. This can be particularly important in combat situations where the stress of combat may reduce an individual's ability to perform tasks quickly and accurately, such as the precise reassembly of a rifle. Furthermore, having the gas from the spent cartridge directed out prior to re-entering the chamber can significantly reduce deposits in the chamber and extends the life of lubricants applied to bolt and bolt carrier, thereby enhancing the time between servicing those components.

In the traditional Stoner design incorporating a gas impingement system the gas tube that provided a conduit for the escaping gas was not firmly clamped to the barrel of the rifle. This meant that the gas tube did not limit the float of the barrel. On the other hand, gas piston systems utilize a long piston assembly that is anchored at one end to a point fairly far out along the barrel. This means of anchoring appears to have the effect of reducing the "float" of the barrel. By reducing the float of the barrel, the rifle becomes less accurate. Consequently, the trade-off for adopting the longer service life of a gas-piston system is a heavier and less accurate rifle. Through the adoption the teachings of the present invention (e.g. the realization that the piston system can be mounted to an alternative structure on the rifle that does not impact the float of the barrel) a rifle can be produced that has the accuracy of a direct impingement system, the service life of a gas piston system, and the weight and maneuverability of a rifle falling somewhere in the middle of the two systems. As such, the design is a very significant advancement over prior designs.

More particularly, the barrel nut represents a point on the rifle that is already locked down to the upper receiver. As such, it provides a static anchoring point. On the other hand, it remains fairly accessible during operation in the field, such that parts affixed to it can be easily broken down, cleaned and serviced. In addition, ending the gas tube at this general location prevents the gases from traveling further back into the chamber of the rifle. This makes the barrel nut a particularly advantageous point for mounting the distal end of the piston assembly.

Figure 7:
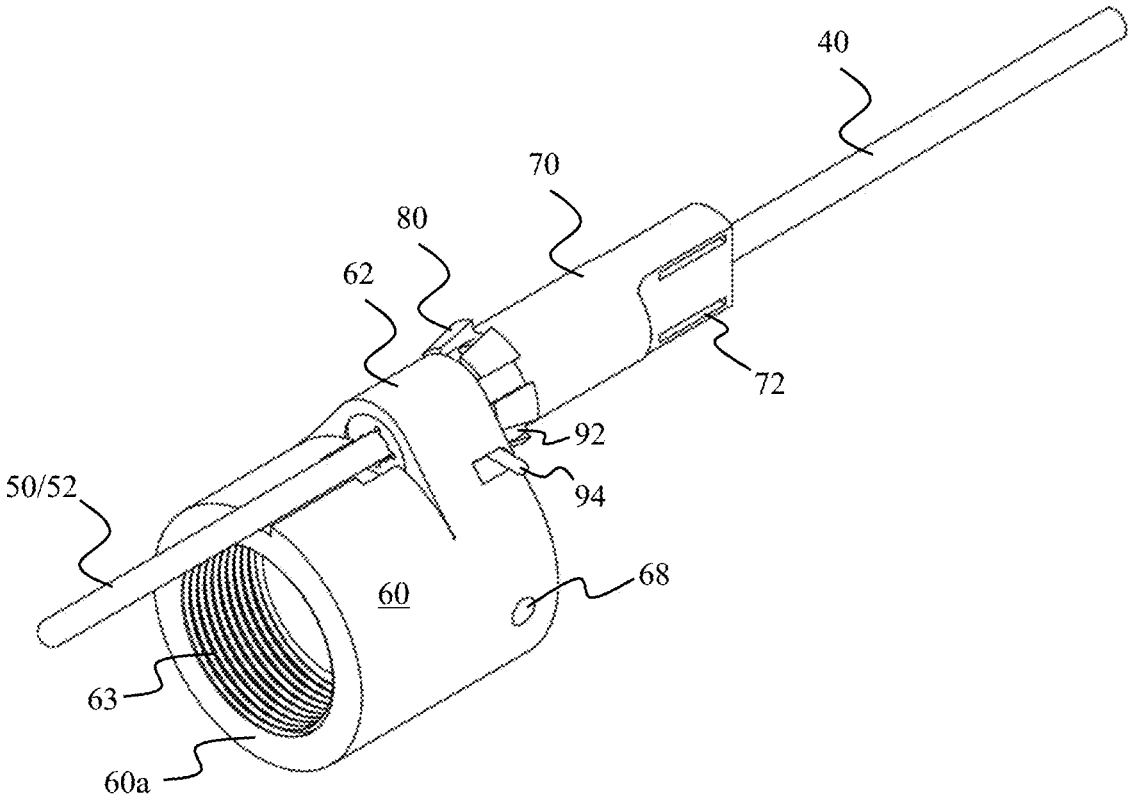
FIG. 7 is a perspective view of the barrel nut assembly components with a gas tube, piston, barrel piston cylinder and barrel piston cap installed in the piston mount aperture of the barrel nut.

FIG. 7 shows an additional view of barrel nut and piston assembly of FIG. 6. FIG. 7 adds the gas tube 40 to the barrel nut 60 with a piston assembly 50 mounted on the piston mount 62 of the barrel nut as shown in FIG. 6.

Figure 8:
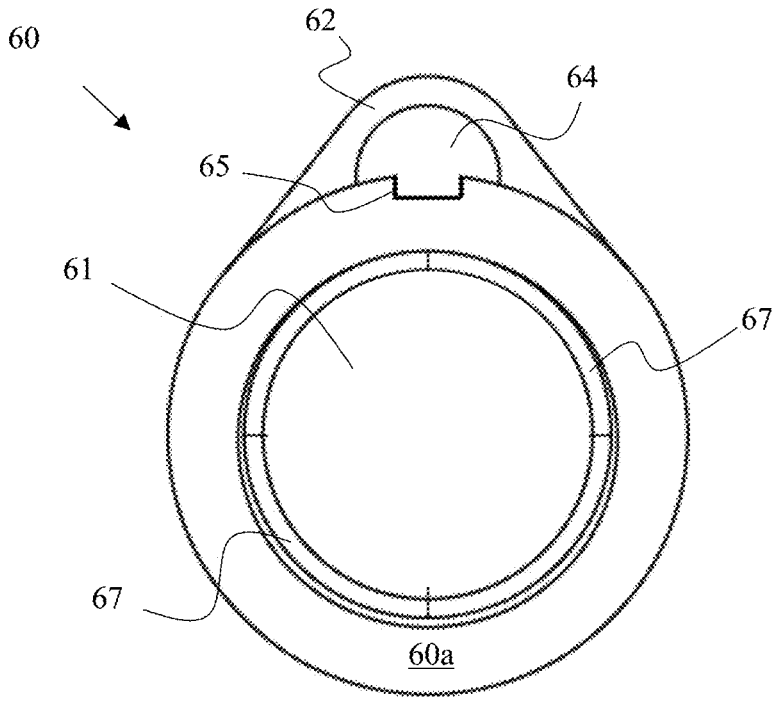
FIG. 8 is a front elevation view of an embodiment of a barrel nut according to aspects of the invention.

Turning to FIG. 8, there is shown the front view of a barrel nut 60 according to aspects of the invention. The barrel nut 60 has a piston mount 62 with an aperture or piston mount bore 64 which is configured to secure the distal end of the piston assembly. The barrel nut 60 includes a barrel nut channel 65 for passage of the piston shaft (See e.g. FIG. 6). The inner surface of the barrel nut 60 has a lip 67 that mates with a taper on or near the proximal end of a barrel to prevent the barrel from sliding completely through the barrel nut bore 61 when a barrel is inserted into the barrel nut 60 for mounting the barrel on a rifle. The barrel nut 60 includes a surface 60*a* that generally contacts the upper receiver when affixed.

Figure 9:
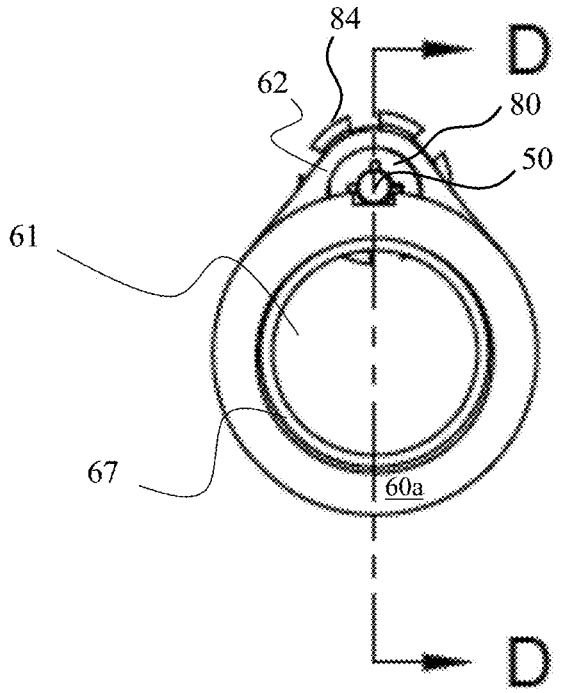
FIG. 9 is a front elevation view of an embodiment of a barrel nut with a piston and barrel piston cylinder installed in the piston mount of the barrel nut. The axis defined by "D" is the axis upon which the cut-away is presented in FIG. 10.

FIG. 9 shows a barrel nut 60 as shown in FIG. 8 with a barrel piston cylinder 80 mounted to the piston mount 62.

Figure 10:
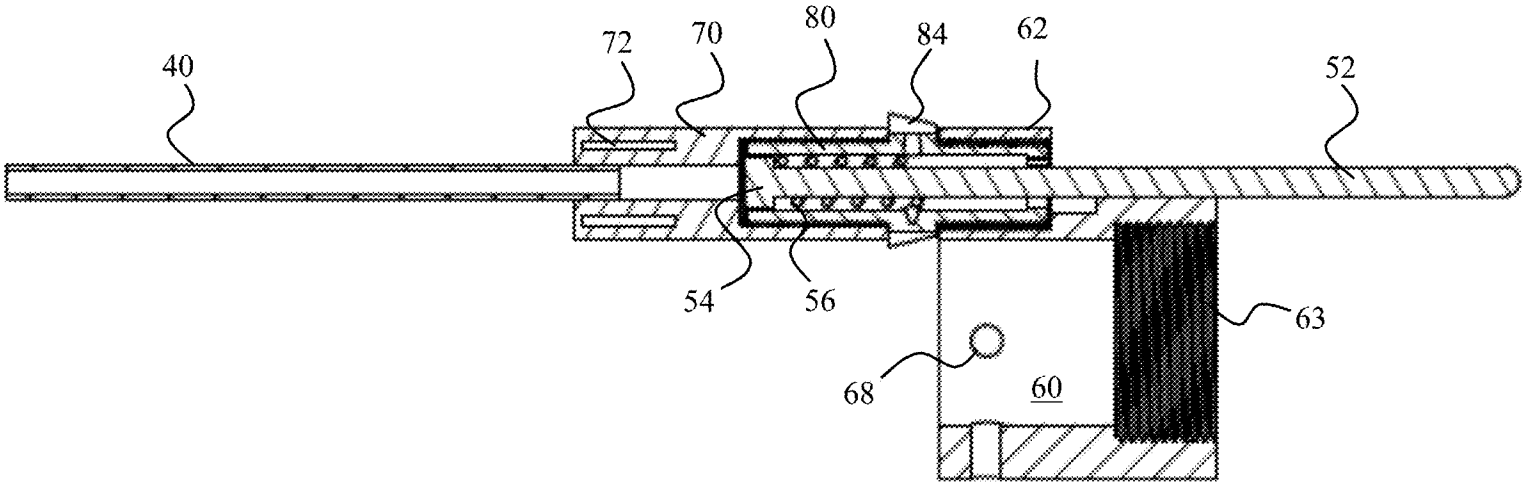
FIG. 10 is a cut-away side elevation view of a barrel nut with a gas tube, piston, barrel piston cylinder and barrel piston cap installed in the piston mount of the barrel nut. The section was taken along the "D" axis as shown in FIG. 9.

FIG. 10 shows a cut-away view of a barrel nut 60 with a piston assembly 50 mounted on the piston mount 62 of the barrel nut. As can be seen in FIG. 10, the barrel piston cylinder 80 is secured to the piston mount 62 using a set of complementary threads. Similarly, the barrel piston cap 70 engages the barrel piston cylinder 80 with a set of complementary threads. The gas tube 40 is slidingly received within a bore in the barrel piston cap 70. The piston assembly, with the piston head 54, the piston rod 52 and the piston spring 56, is secured within the chamber formed by the barrel piston cylinder 80 and the barrel piston cap 70.

Figure 11:
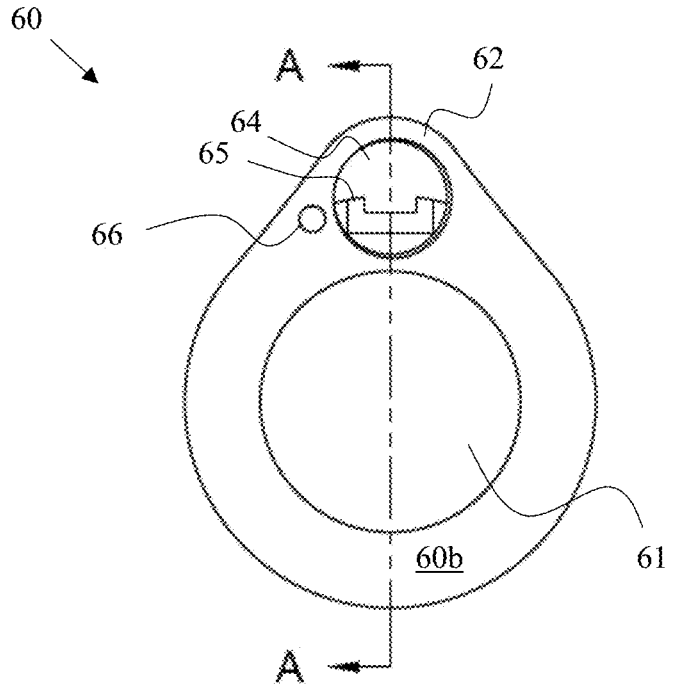
FIG. 11 is a rear elevation view of an embodiment of a barrel nut as shown in FIG. 8. The axis defined by "A" is the axis upon which the cut-away is presented in FIGS. 12 and 15.

FIG. 11 shows a rear view of the barrel nut 60 shown in FIG. 8. The barrel nut 60 has a piston mount 62 that is flush with the rear surface 60*b* of the barrel nut 60. The piston mount 62 has an aperture 64 which is configured to receive and secure the distal end of piston assembly. The superior outside surface of the barrel nut 60 includes a piston slot 65 to provide passage and clearance of the piston shaft 52 (See e.g. FIG. 7) and to allow air to escape from the barrel piston chamber. The piston mount 62 has piston lock slot 66 securing and defining the fore-aft movement of the piston lock 90 (See e.g. FIG. 26). Additional views of the piston slot 65 and the piston lock slot 66 can be seen in FIGS. 6 and 7. As can be seen in FIGS. 8 and 11, the barrel nut 60 has a pair of bores (61 and 64) extending completely through the barrel nut. The lower bore, the barrel nut bore 61, allows for the barrel of the rifle to be inserted into the barrel nut 60 and secured to the receiver of the rifle. The upper bore, the piston mount aperture 64, facilitates the insertion and securing of the barrel piston assembly components, such as is shown in FIGS. 6 and 7.

Figure 12:
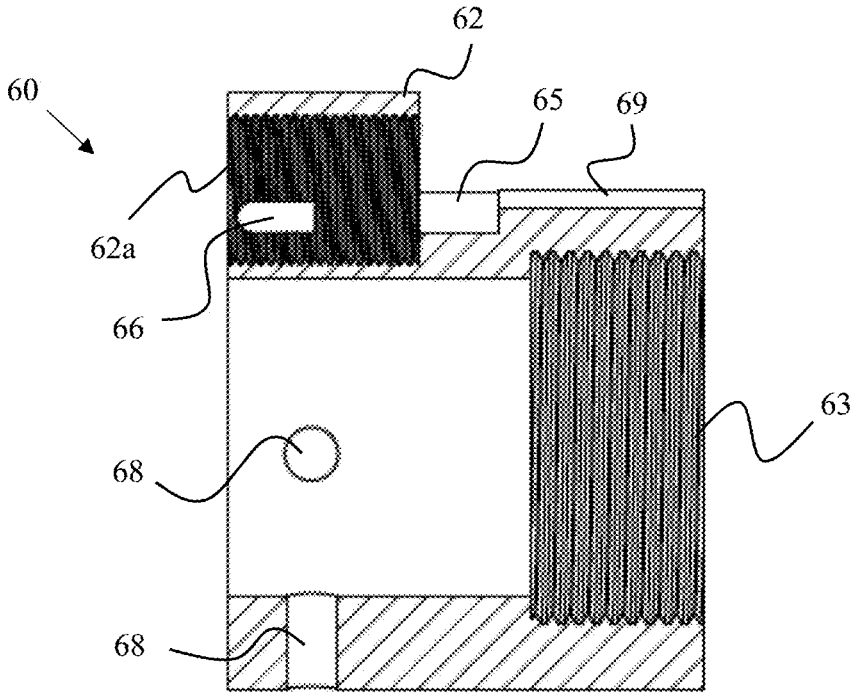
FIG. 12 is a cut-away side elevation view of an embodiment of a barrel nut as shown in FIG. 11. The section was taken along the "A" axis as shown in FIG. 11.
Figure 13:
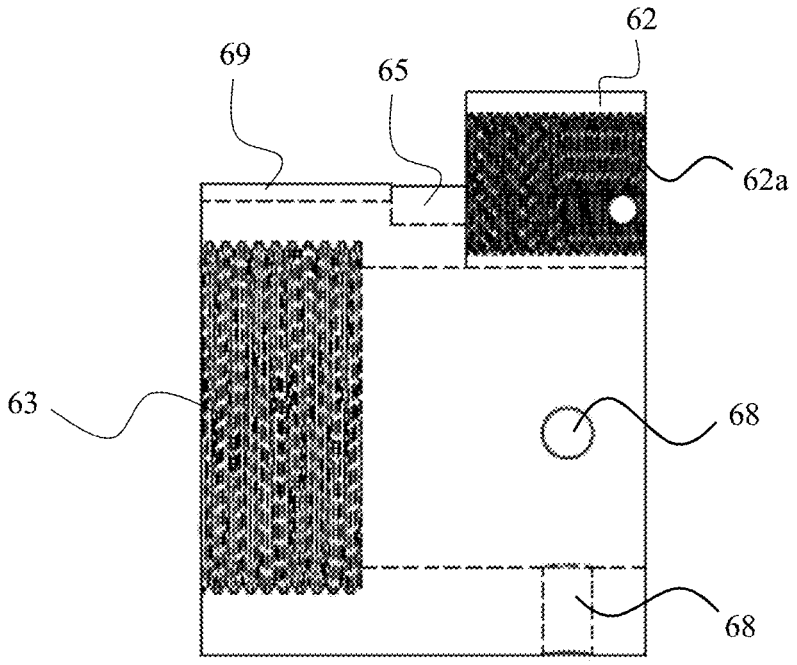
Figure 14:
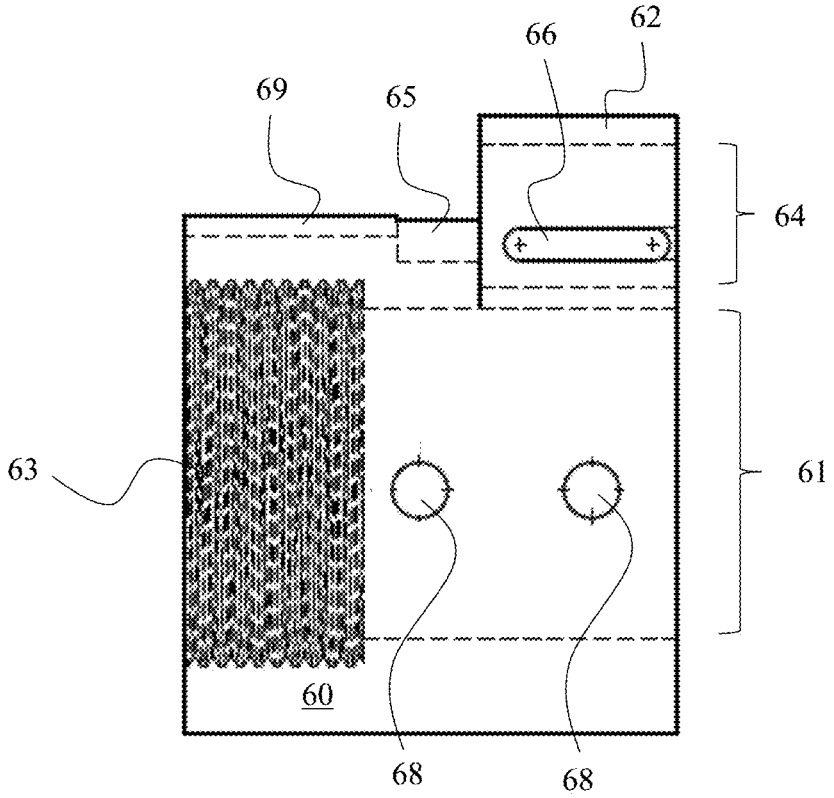
FIG. 14 is a side elevation view of an alternative embodiment of the barrel nut as shown in FIG. 13.
Figure 15:
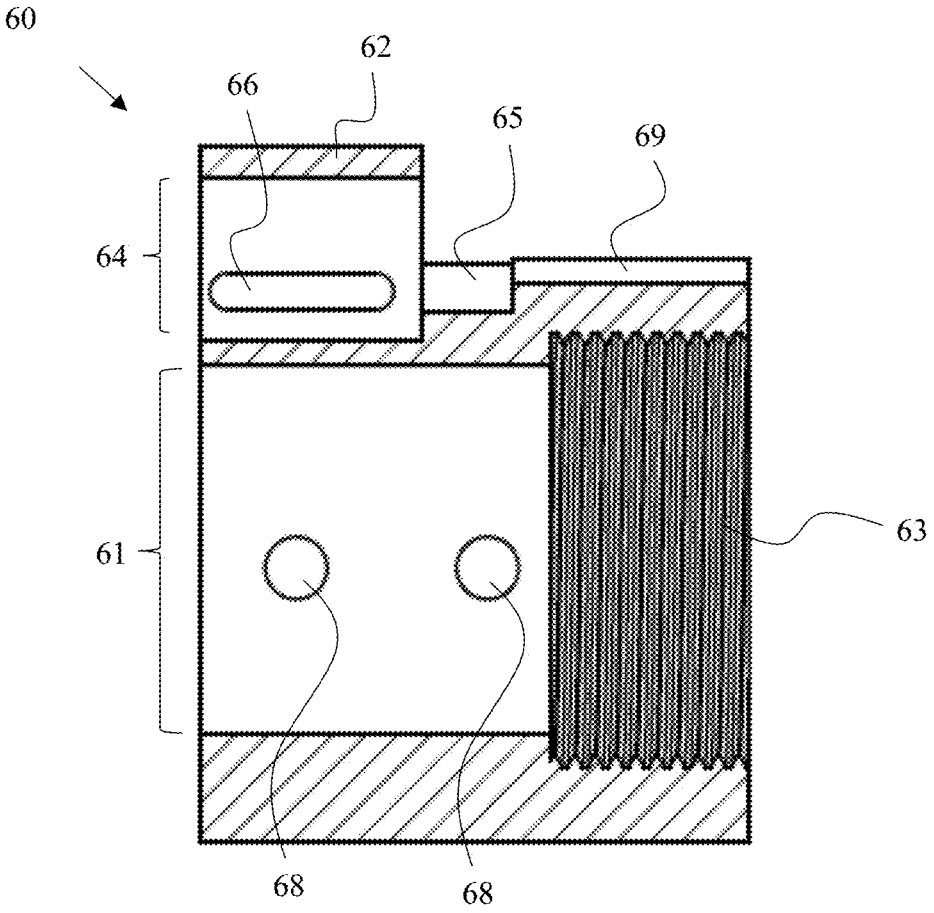
FIG. 15 is a cut-away side elevation view of an alternative embodiment of a barrel nut as shown in FIG. 12. The section was taken along the "A" axis as shown in FIG. 11.
Figure 16:
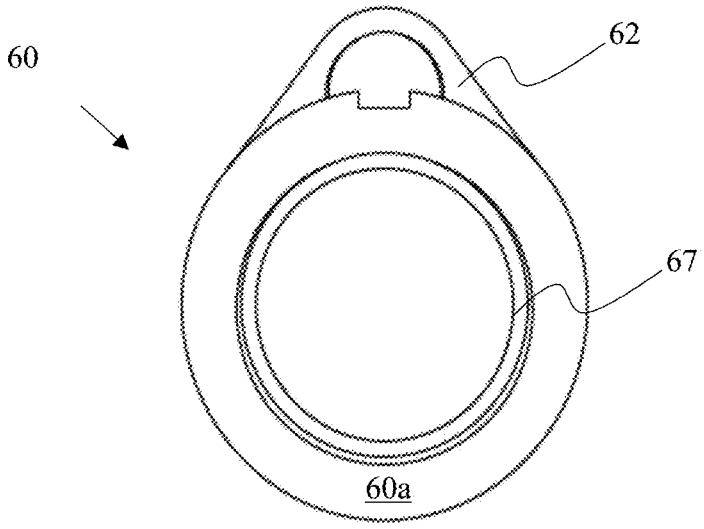
FIG. 16 is a second front elevation view of the barrel nut shown in FIG. 8.

FIG. 12 shows a side cut-away view of a barrel nut 60 according to aspects of the invention. The barrel nut has a piston mount 62 with threads 62*a* designed to match complementary threads on a barrel piston cylinder. The barrel nut also has threads 63 to secure the barrel nut to complementary threads on the upper receiver of a rifle. The piston mount threads 62*a* are roughly co-planar with the barrel nut threads 63. The piston mount 62 of the barrel nut has piston lock slot 66 securing and defining the fore-aft movement of the piston lock 90 (See e.g. FIG. 26). Barrel nut 60 has a piston slot 65 and piston channel 69 cut along the axis of the barrel piston assembly to allow for proper alignment and clearance of the piston operating rod. FIG. 13 shows a side ghost view of the opposite side of the barrel nut shown in FIG. 12. FIG. 14 shows a side ghost view of an alternative embodiment of a barrel nut. The barrel nut shown in FIG. 14 has a pair of holes 68 positioned to facilitate the mounting of a handguard to the rifle. FIG. 15 shows a side ghost view of the opposite side of the barrel nut shown in FIG. 14. FIG. 16 shows a front view of a barrel nut 60 according to aspects of the invention.

Figure 17:
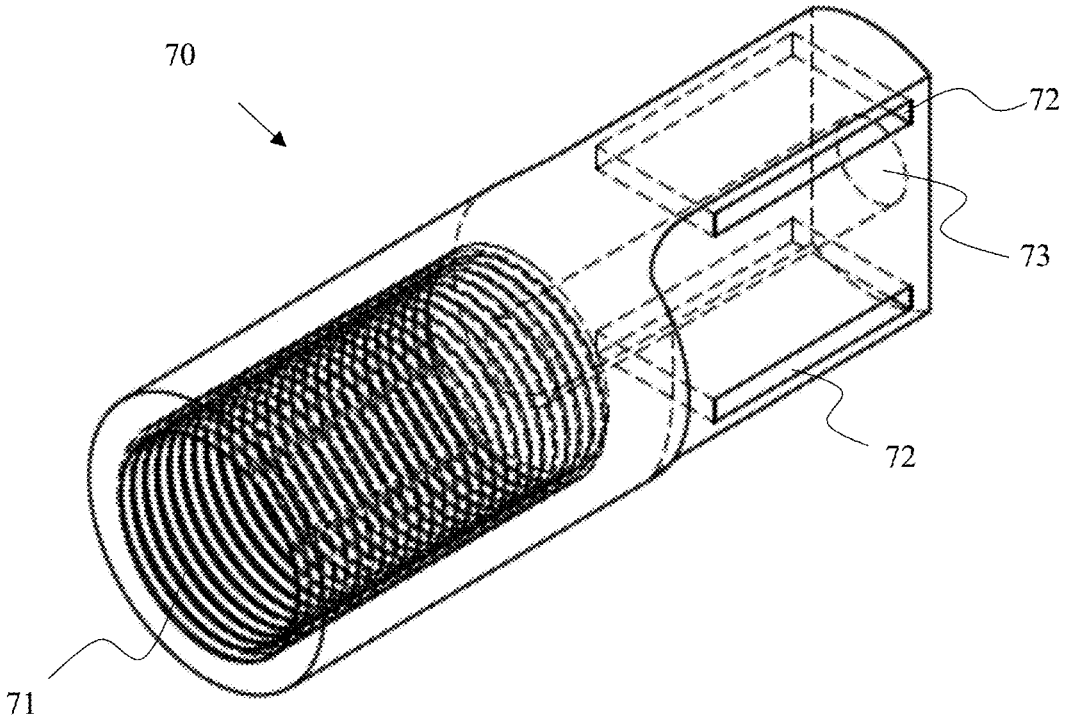
FIG. 17 is a perspective ghost view of a barrel piston cap according to aspects of the invention.
Figure 18:
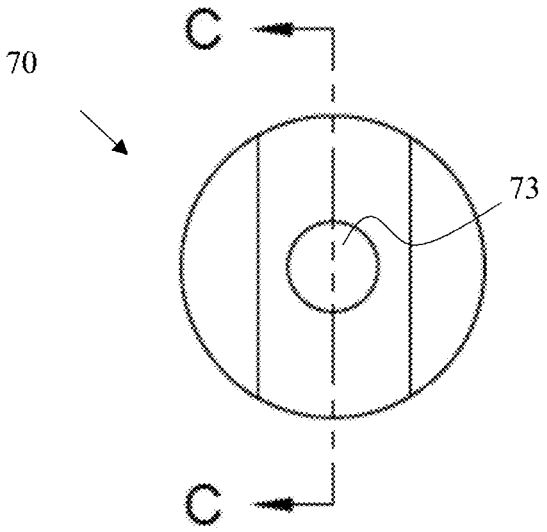
FIG. 18 is a rear elevation view of a barrel piston cap according to aspects of the invention. The cut-away view depicted in FIG. 19 is sectioned along the axis "C" as shown in this figure.
Figure 19:
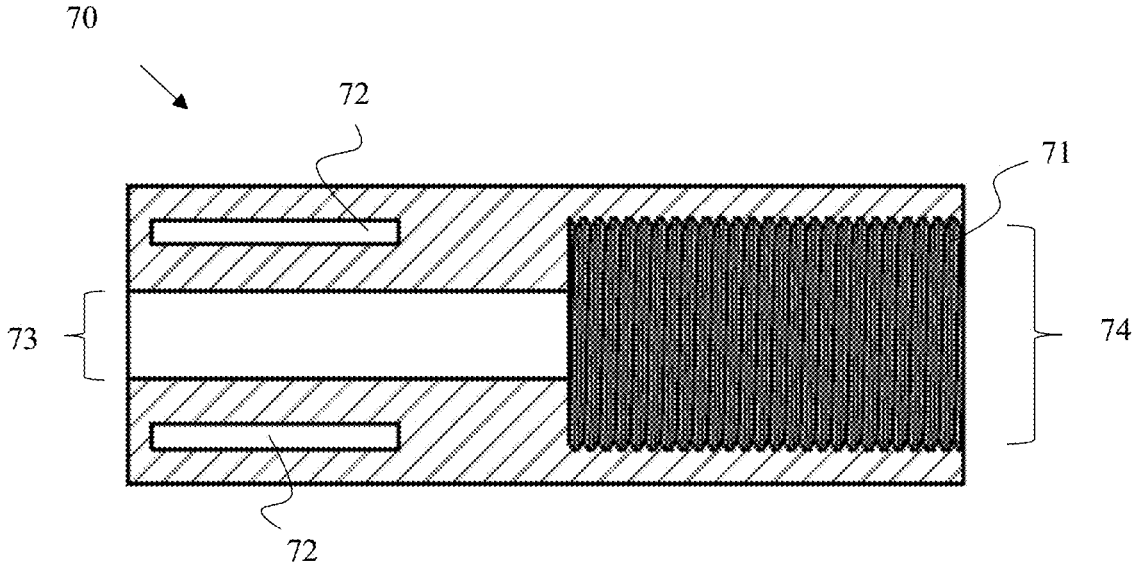
FIG. 19 is a cut-away side elevation view of an embodiment of a barrel piston cap as shown in FIG. 18. The section was taken along the "C" axis as shown in FIG. 18.
Figure 20:
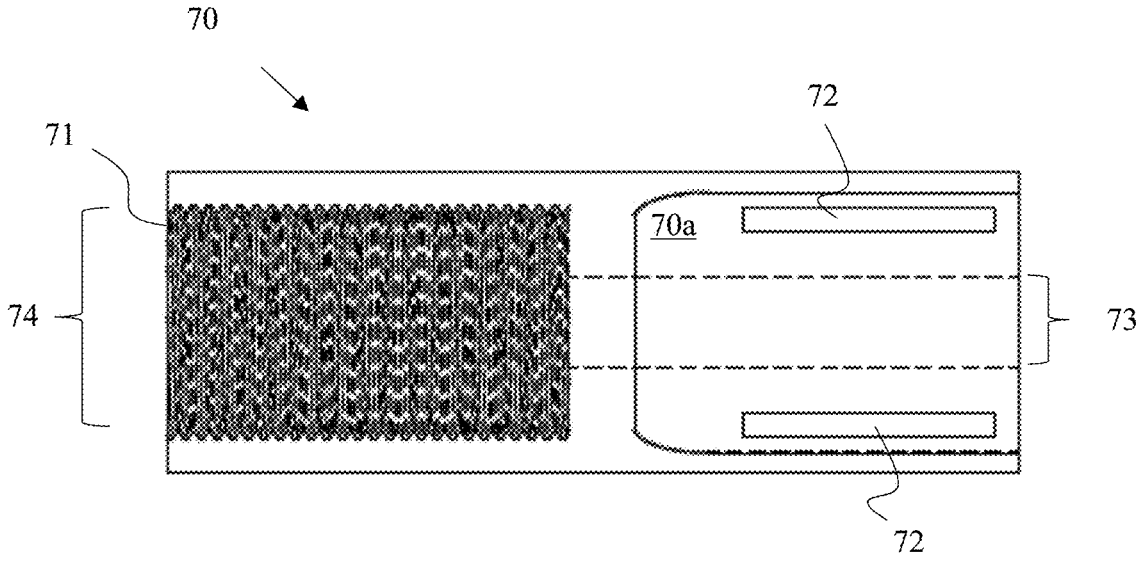
FIG. 20 is a side elevation ghost view of an embodiment of a barrel piston adapter as shown in FIG. 18.

FIG. 17 shows a perspective ghost view of a barrel piston cap 70. The barrel piston cap 70 has threads 71 on its inner surface that engage complementary threads 82 (see FIG. 21) on the outer surface of the barrel piston cylinder 80 to form a piston chamber of the barrel piston assembly when the barrel piston cap 70 is assembled to the barrel piston cylinder 80. The barrel piston cap 70 has a pair of barrel piston adapter slots 72 designed to receive the end of a flat article such as a screw driver or knife. The barrel piston cap 70 has a pair of opposed flat surfaces 70*a* (see FIGS. 6 and 20) designed to engage a wrench of appropriate size to facilitate rotation of the barrel piston cap 70 has when disengaging the adapter from the barrel piston cylinder 80. The barrel piston cap 70 has a gas tube bore 73 dimensioned to receive a gas tube within the barrel piston cap 70. The diameter of the bore 73 should be just slightly greater than the diameter of the gas tube which is to be inserted into the bore to ensure that the tube is snugly held within the bore and that the exhaust gases are directed into the piston chamber rather than passing back out of the space between the bore and the gas tube. Alternative views of the barrel piston cap 70 shown in FIG. 17 can be seen in FIGS. 18 through 20.

Figure 21:
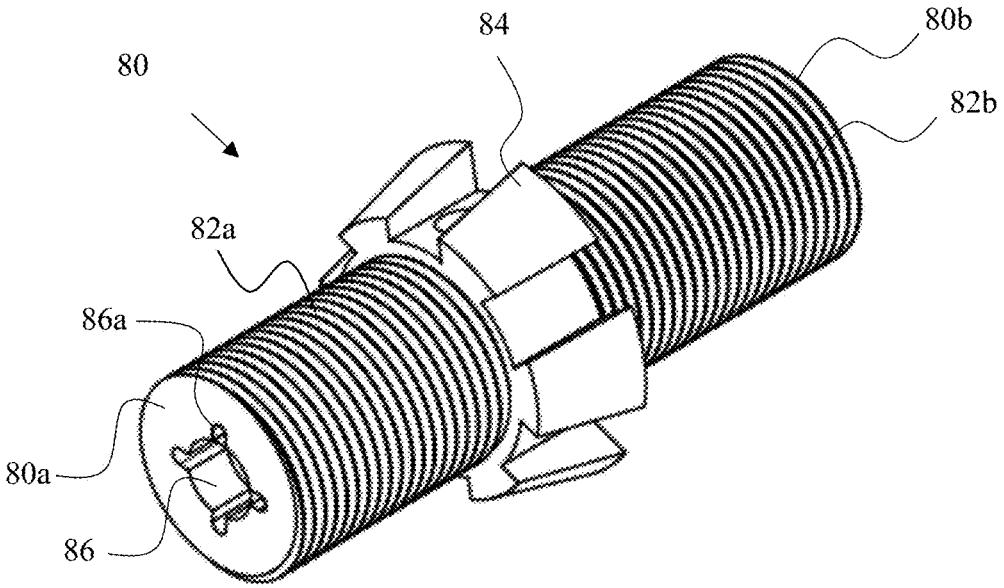
FIG. 21 is a perspective view of a barrel piston cylinder according to aspects of the invention.

FIG. 21 shows a barrel piston cylinder 80 according to aspects of the invention. The barrel piston cylinder 80 has a cylindrical shape with threads 82 on the outer surface. Threads 82*a* engage complementary threads on the piston mount, while thread 82*b* engage complementary threads on the barrel piston cap. The barrel piston cylinder 80 has a first end 80*a* that is proximal to the buttstock of the rifle when installed in the piston mount 62 and a second end 80*b* that is distal to the buttstock. The threads 82*b* on the distal end of the outer surface of the barrel piston cylinder 80 engage complimentary threads on the inner surface of the barrel piston cap 70. The barrel piston cylinder 80 has a castle 84 at roughly the midpoint of the outer surface of the cylinder to facilitate grasping the barrel piston cylinder 80 with a user's hand to turn or hold the barrel piston cylinder 80, such as when disengaging the barrel piston cylinder 80 from the barrel piston cap 70. The castle 84 also allows the barrel piston cylinder to be locked in place with the piston lock (see FIG. 7).

Figure 22:
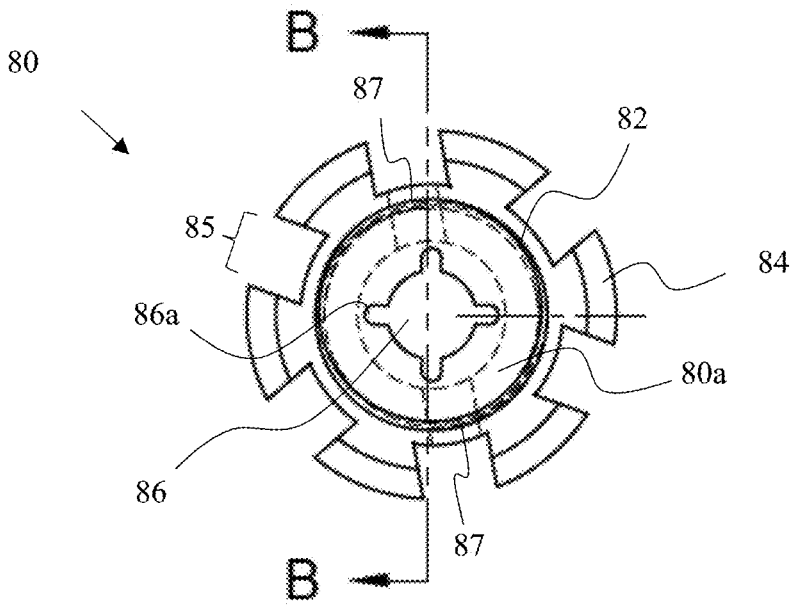
FIG. 22 is a front elevation view of the barrel piston cylinder shown in FIG. 21. The view depicted in FIG. 23 is sectioned along the axis "B" as shown in this figure.

Turning to FIG. 22, the barrel piston cylinder 80 has a pair of gas venting ports 87 between adjacent peaks of the castle 84. The barrel piston cylinder 80 has a piston bore 86 for passage of the piston shaft 52 (see e.g. FIG. 3). The piston bore 86 has four ports 86*a* that allow air to escape from the piston chamber region behind the piston head when the piston is forced back by exhaust gases.

The piston rod of the barrel piston 50 (see FIG. 16) can be inserted into and through the piston bore 86 of the barrel piston cylinder 80. The piston spring 56 would contact the bottom 89 (see FIG. 23) of the barrel piston cylinder 80 when the piston head is driven back by exhaust gases.

When the barrel piston cylinder 80 is assembled into the barrel piston cap 70, a chamber is formed with the piston head 54 and a piston spring 56 within the barrel piston chamber 88 (not shown). Between firing cycles, the piston head would be held in position near the distal end of the chamber by the force of the buffer tube spring. When a round is fired, the exhaust gases travel down the gas tube, where they enter the barrel piston chamber and force the piston head back, compressing the piston spring. The piston spring prevents the piston head from slamming into the bottom of the barrel piston cylinder. Once the piston head has traveled far enough in the rearward direction, the gas venting ports 87 are exposed, which allow the exhaust gas to vent from the chamber, reducing the pressure that has built up in the chamber. After the pressure in the piston chamber has decreased, the buffer tube spring rebounds, returning the piston head to its extended position.

Figure 23:
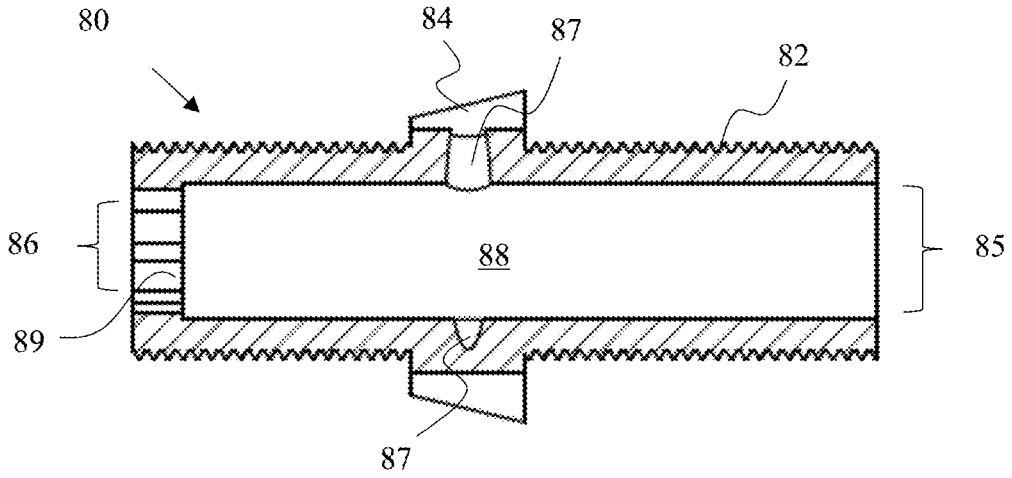
FIG. 23 is a cut-away side elevation view of the barrel piston cylinder shown in FIG. 21. The view depicted in FIG. 23 is sectioned along the axis "B" as shown in in FIG. 22.
Figure 24:
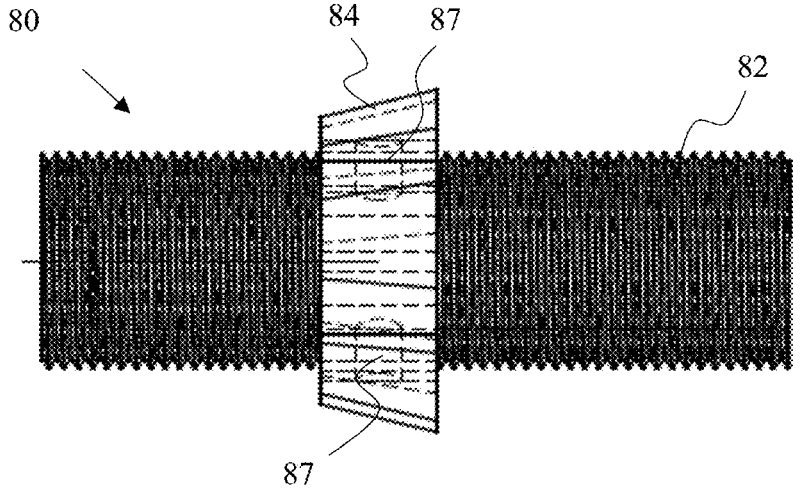
FIG. 24 is a side elevation view of the barrel piston cylinder shown in FIG. 21.

FIG. 23 shows an alternative view of the barrel piston cylinder 80 shown in FIG. 21. As can be seen in the figure, there are a pair of gas venting ports 87 on opposing sides of the barrel piston cylinder 80 in communication with the inner chamber 88 (See e.g. FIG. 15) of the barrel piston cylinder 80. FIG. 24 shows a side view of the barrel piston cylinder 80 shown in FIG. 21.

FIG. 23 shows a cut-away view of the barrel piston cylinder 80 along the B axis as shown in FIG. 22. The barrel piston cylinder 80 has an inner chamber 88 with a set of gas venting ports 87 at roughly the midpoint of the cylinder and a barrel piston chamber wall 89 at the first end of the barrel piston cylinder.

FIG. 24 shows a ghost view of the barrel piston cylinder 80 as shown in FIG. 23.

Figure 25:
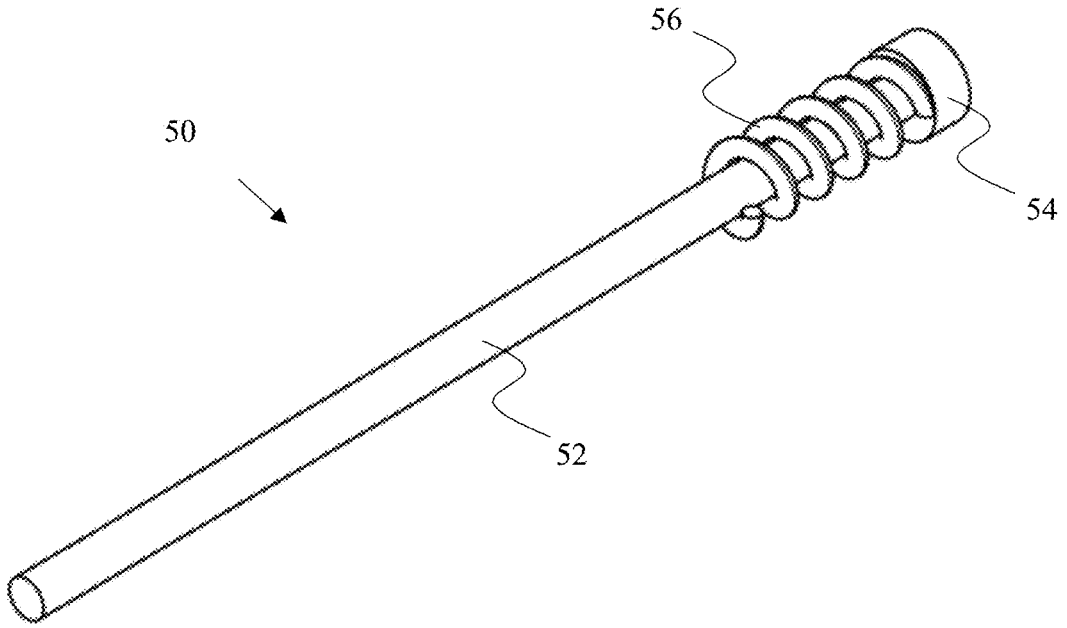
FIG. 25 is a perspective view of a piston assembly according to aspects of the invention.

FIG. 25 shows a piston 50 according to aspects of the invention. The piston 50 has a piston rod 52, a piston head 54 and a piston spring 56. The gaseous force propagating down the gas tube applies force to the head of the piston, moving the piston shaft 52 in a direction towards the buttstock of the rifle and compressing the piston spring 56. The rearward movement of the piston 50 pushes the piston rod 52 back against the key on the bolt carrier. The bolt carrier the moves in the same rearward direction resulting in cycling the spent round out of the chamber and loading a new round into the chamber.

Figure 26:
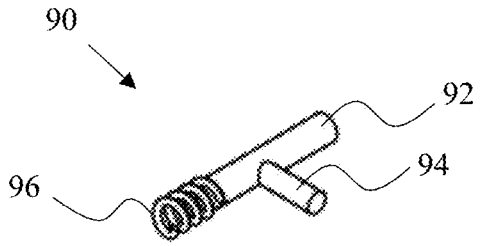
FIG. 26 is a perspective view of a piston lock assembly according to aspects of the invention.

FIG. 26 shows a piston lock 90 according to aspects of the invention. The piston lock 90 is a spring-loaded barrel bolt lock that slots between adjacent peaks 85 (see FIG. 22) in the castle to prevent the barrel piston cylinder 80 has from rotating during operation, thereby keeping the barrel piston cylinder locked in the piston mount.

Figure 27:
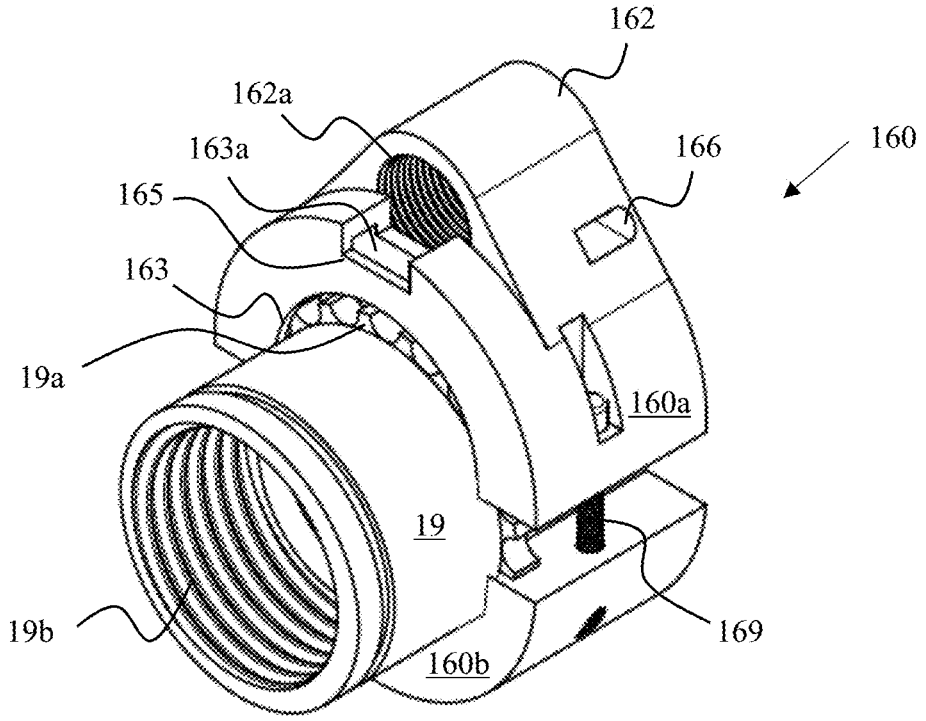
FIG. 27 is a perspective view of a piston mount adapter where the lower member of the piston mount adapter is contacting a barrel nut and the upper member of the adapter is removed from the barrel nut, thus exposing the top half of the barrel nut.

FIG. 27 shows a perspective view of a piston mount adapter 160 being mounted on a conventional barrel nut 19. Conventional barrel nuts 19 are generally cylindrical in shape with a set of threads 19*b* over a portion of their inner surface (See e.g. FIG. 39). The threads 19*b* are designed to engage complementary threads on an upper receiver of a rifle. The inner surface of the barrel nut will generally have a smaller diameter after the threads stop on the inner surface. This reduced diameter allows the barrel nut to securely hold the barrel of the rifle, which has a taper on the proximal end of the rifle barrel. In contrast the outer diameter of the barrel nut is generally constant. The outer surface of the barrel nut includes an index 19*a* that projects from and encircles the barrel nut towards the distal end of the barrel nut.

The piston mount adapter 160 is designed to be securely affixed to the barrel nut 19. The piston mount adapter 160 has an upper piston mount member 160*a* and a lower piston mount adapter member 160*b*. The upper piston mount member 160*a* and a lower piston mount adapter member 160*b* are fastened together over the barrel nut 19 with a pair of bolts 169. The piston mount adapter 160 has a piston mount 162 on the superior aspect of upper piston mount member 160*a*. The piston mount 162 has an aperture 164 or bore (see FIGS. 28 and 30) that is generally parallel with the axis of the barrel of a rifle when the adapter is mounted on a barrel nut of a rifle. The inner surface of the aperture 164 can have threads 162*a* (see FIG. 12) to engage complementary threads on a barrel piston cylinder 80 (see e.g. FIG. 36). The piston mount 162 is designed to sit directly above the barrel of the rifle (e.g. at 12'oclock), and distal to the threads of the barrel nut, when the barrel nut is properly mounted to an upper receiver. This ensures that the aperture 164 of piston mount 162 is in the proper position to receive the components of the gas-piston system. More specifically, it has been found that threads of the piston mount should preferably not be positioned above the threads of the barrel nut (i.e. the threads that mount the barrel nut to the upper receiver). Similarly, the piston mount of the piston mount adapter should be mounted distal to the threads of the barrel nut. More advantageously, the piston mount on the piston mount adapter can be distal to the index 19*a* of the barrel nut 19. This ensures that the aperture 164 of the piston mount can be made of sufficient size to receive the threaded portion of the barrel piston cylinder 80. Decreasing the size of the aperture 164 leads to a decrease on the size/diameter of the barrel piston cylinder 80 at the point where the barrel piston cylinder threads into the aperture 164, which in turn reduces the size/diameter of the piston rod 52, piston head 54, and/or the piston spring 56. To maintain the proper geometry, the piston rod should be roughly 0.783 inches from the centerline of the barrel (0.783 inches for the M16 and AR-15; 0.845 inches for the AR-10 rifle) for the piston rod to properly contact the key on the bolt carrier. This geometry is not optimally achieved when a sufficiently sized aperture 164 is located over the threads 19*b* of the barrel nut.

The superior outside surface of the piston mount adapter 160 has a piston slot 165 to provide passage and clearance of the piston shaft 52 and to allow air to escape from the barrel piston chamber. The piston mount adapter 160 also has circular index channel 163 on its inner surface. The index channel is designed to receive the index 19*a* of the barrel nut 19. The index channel 163 can also be seen in FIGS. 32 and 33. The index channel 163 has an index channel window 163*a*, where the index 19*a* extends through the outer surface of the piston mount adapter 160 (See FIGS. 34 and 35). The piston mount 162 has piston lock slot 166 securing and defining the fore-aft movement of the piston lock 90 (See e.g. FIG. 36).

Figure 28:
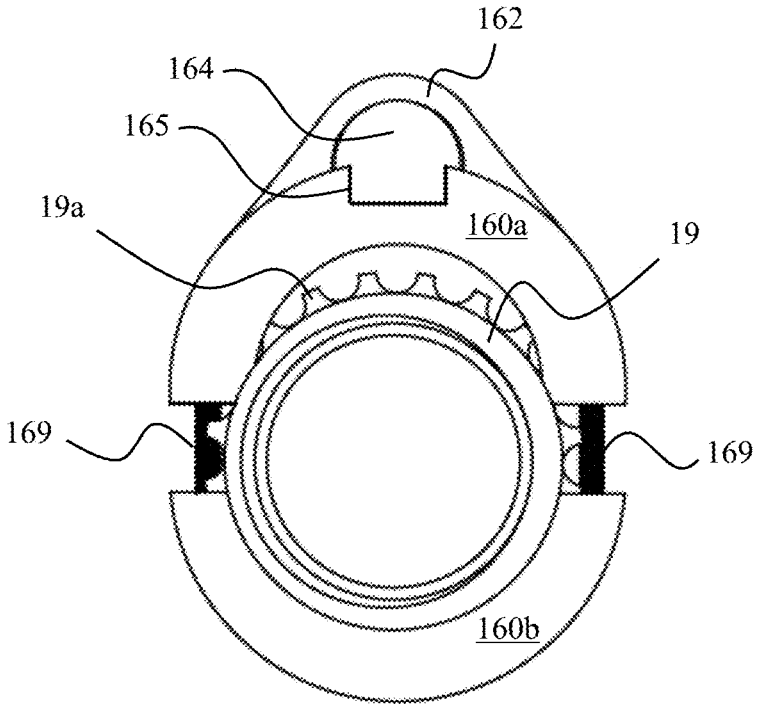
FIG. 28 is a front perspective view of a piston mount adapter where the lower member of the piston mount adapter is contacting the barrel nut and the upper member of the adapter is removed from the barrel nut.

FIG. 28 shows a second perspective view of a piston mount adapter 160 being mounted on a conventional barrel nut 19. The second perspective view shows the proximal side of the piston mount adapter 160 being mounted on a conventional barrel nut 19. The lower piston mount adapter member 160*b* is shown mounted on the barrel nut, while the upper piston mount member 160*a* and is raised above the barrel nut 19. The upper piston mount member 160*a* and a lower piston mount adapter member 160*b* are fastened together over the barrel nut 19 with a pair of bolts 169.

Figure 29:
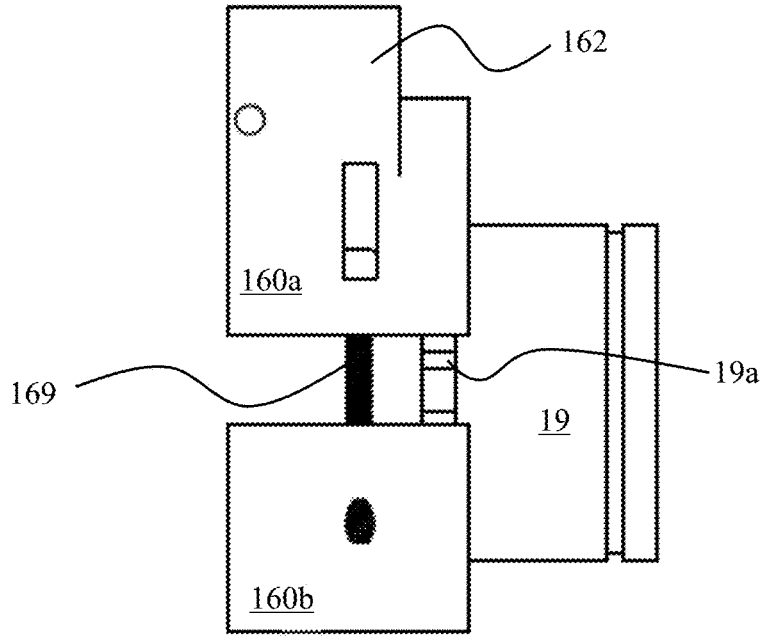
FIG. 29 is a side view of a piston mount adapter where the lower member of the piston mount adapter is contacting the barrel nut and the upper member of the adapter is removed from the barrel nut.

FIG. 29 shows a side elevation view of a piston mount adapter 160 being mounted on a conventional barrel nut 19. The view shows a piston mount adapter 160 being mounted on the distal end of a conventional barrel nut 19 just over the index 19*a* of the barrel nut 19. The lower piston mount adapter member 160*b* is shown mounted on the barrel nut, while the upper piston mount member 160*a* and is raised above the barrel nut 19. The upper piston mount member

160*a* and a lower piston mount adapter member 160*b* are fastened together over the barrel nut 19 with a pair of bolts 169.

Figure 30:
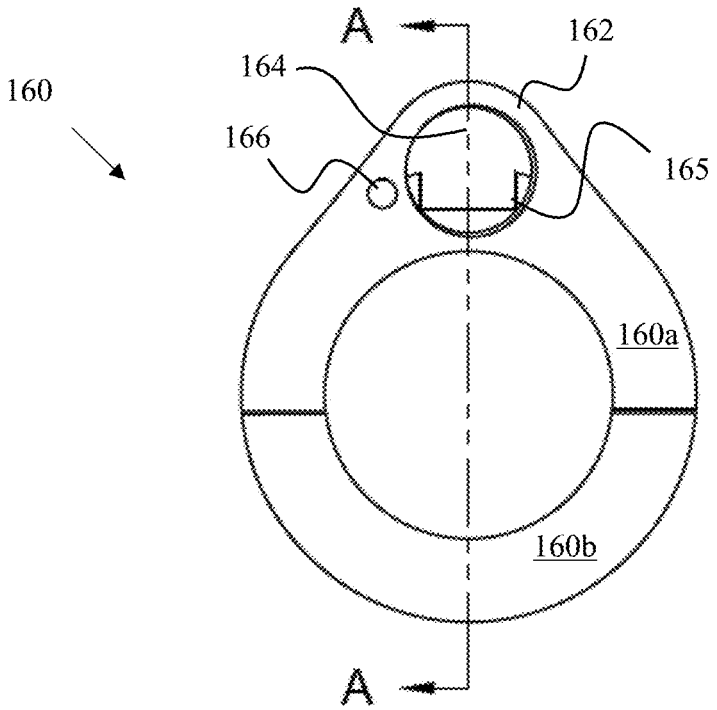
FIG. 30 is a rear elevation view of a piston mount adapter. The axis defined by "A" is the axis upon which the ghost view is presented in FIG. 32 and the cut-away is presented in FIG. 33.

FIG. 30 shows an elevation view of the distal side piston mount adapter 160.

Figure 31:
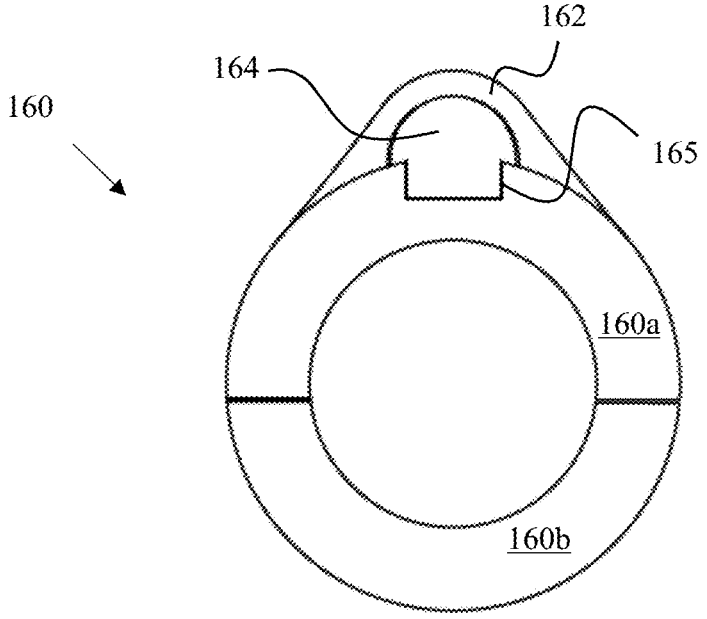
FIG. 31 is a front elevation view of the piston mount adapter.

The upper piston mount member 160*a* and a lower piston mount adapter member 160*b* are fastened together to form the piston mount adapter 160. The piston mount adapter 160 has a piston mount 162 on the superior aspect of upper piston mount member 160*a*. The piston mount 162 has an aperture 164 or bore that is generally parallel with the axis of the barrel of a rifle when the adapter is mounted on a barrel nut of a rifle. The superior outside surface of the piston mount adapter 160 has a piston slot 165 to provide passage and clearance of the piston shaft 52 and to allow air to escape from the barrel piston chamber. The piston mount 162 has piston lock slot 166 securing and defining the fore-aft movement of the piston lock 90 (See e.g. FIG. 36). FIG. 31 shows an elevation view of the proximal side piston mount adapter 160 shown in FIG. 30.

Figure 32:
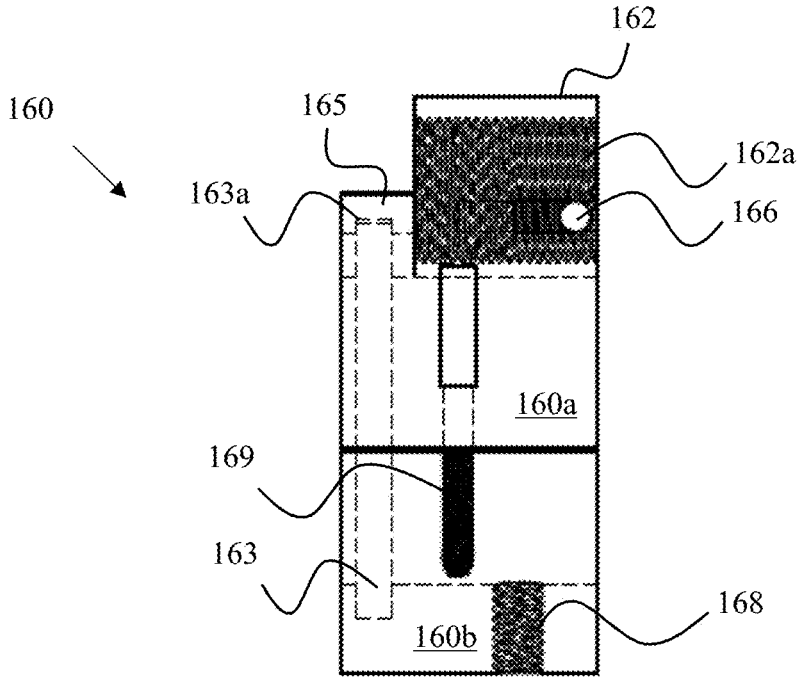
FIG. 32 is a ghost side elevation view of an embodiment of a piston mount adapter as shown in FIG. 30. The section was taken along the "A" axis as shown in FIG. 30.
Figure 33:
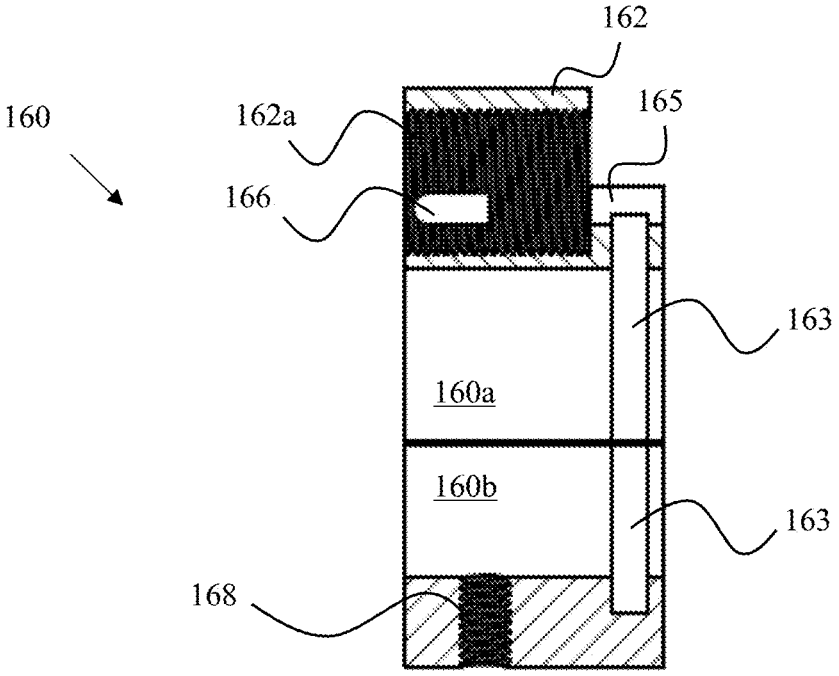
FIG. 33 is a cut-away side elevation view of an embodiment of a piston mount adapter as shown in FIG. 30. The section was taken along the "A" axis as shown in FIG. 30.

FIG. 32 shows a side elevation ghost view of the piston mount adapter 160 shown in FIG. 30. The piston mount adapter 160 has circular index channel 163 on its inner surface, with an index channel window 163*a* where the index 19*a* extends through the outer surface of the piston slot 165 on the upper piston mount member 160*a*. The upper piston mount member 160*a* and a lower piston mount adapter member 160*b* are fastened together over the barrel nut 19 with a pair of bolts 169. The piston mount adapter 160 has a piston mount 162 on the superior aspect of upper piston mount member 160*a*. The inner surface of the piston mount 162 can have threads 162*a* to engage complementary threads on a barrel piston cylinder 80. The piston mount adapter 160 can have one or more threaded holes 168 positioned to facilitate the mounting of a handguard to the rifle. The piston mount 162 has piston lock slot 166 securing and defining the fore-aft movement of the piston lock 92 (See e.g. FIG. 36). FIG. 33 shows a side elevation cut-away view of the piston mount adapter 160 shown in FIG. 30. The ghost view in FIG. 32 and the cut-away view in FIG. 33 were taken along axis A as shown in FIG. 30.

Figure 34:
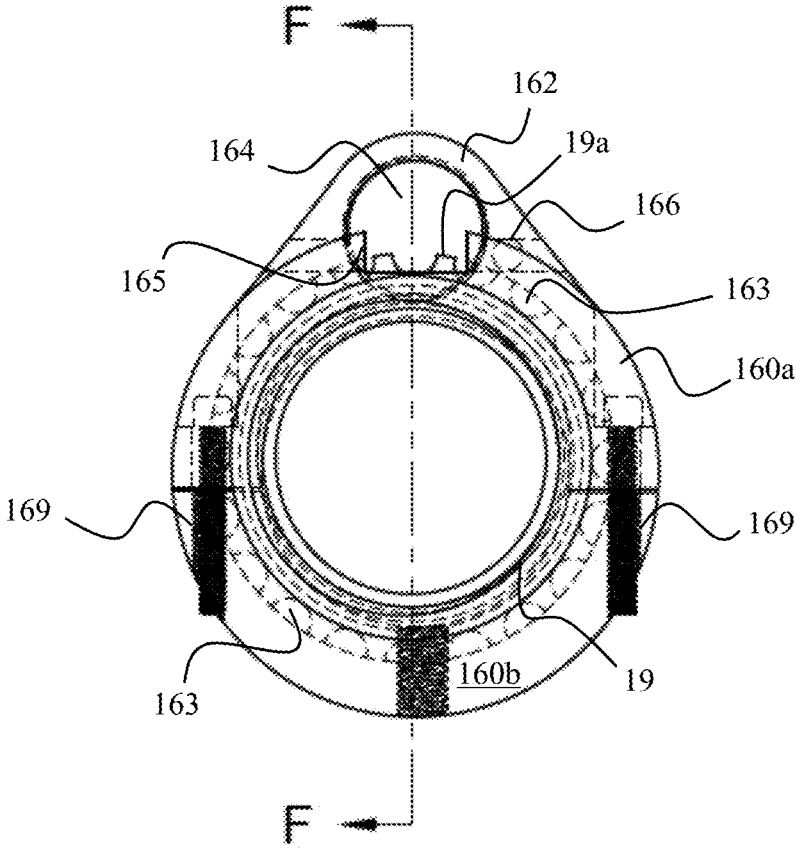
FIG. 34 is a front ghost elevation view a piston mount adapter clamped to a conventional barrel nut. The axis defined by "F" is the axis upon which the cut-away is presented in FIG. 35.
Figure 35:
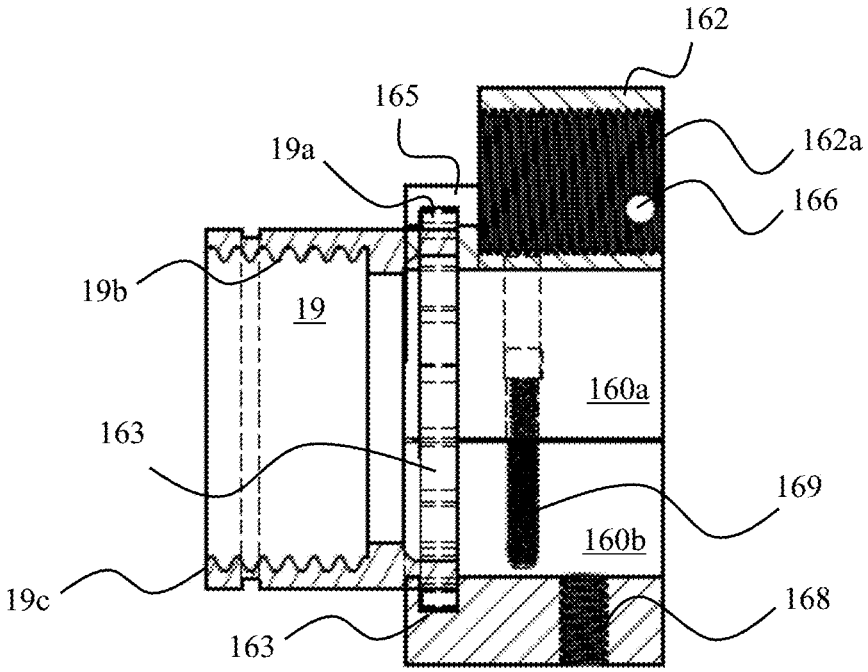
FIG. 35 is a cut-away side elevation view of a piston mount adapter clamped to a conventional barrel nut as shown in FIG. 34. The section was taken along the "F" axis as shown in FIG. 34.

FIG. 34 shows a front elevation ghost view of the proximal side of a piston mount adapter 160 mounted on a conventional barrel nut 19. The index 19*a* of the barrel nut 19 can be seen extending out of the index channel window 163*a* through the outer surface of the piston slot 165 on the upper piston mount member 160*a*. The index channel 163 can be seen running circumferentially around the inner surface of the piston mount adapter 160 on both the upper piston mount member 160*a* and the lower piston mount adapter member 160*b*. The slots between adjacent peaks of the index 19*a* must align with the piston rod 52 such that the piston rod can pass between a valley between peaks in the index 19*a* (See e.g. FIG. 36). FIG. 35 shows a side elevation ghost view of the piston mount adapter 160 mounted on a barrel nut 19 as shown in FIG. 34. The cut-away view in FIG. 35 was taken along axis F as shown in FIG. 34. As can be seen in FIG. 35, the piston mount threads 162*a* are roughly coplanar with the barrel nut threads 19*b*, highlighting the significance of not positioning the piston mount threads 162*a* over the barrel nut threads 19*b*.

Figure 36:
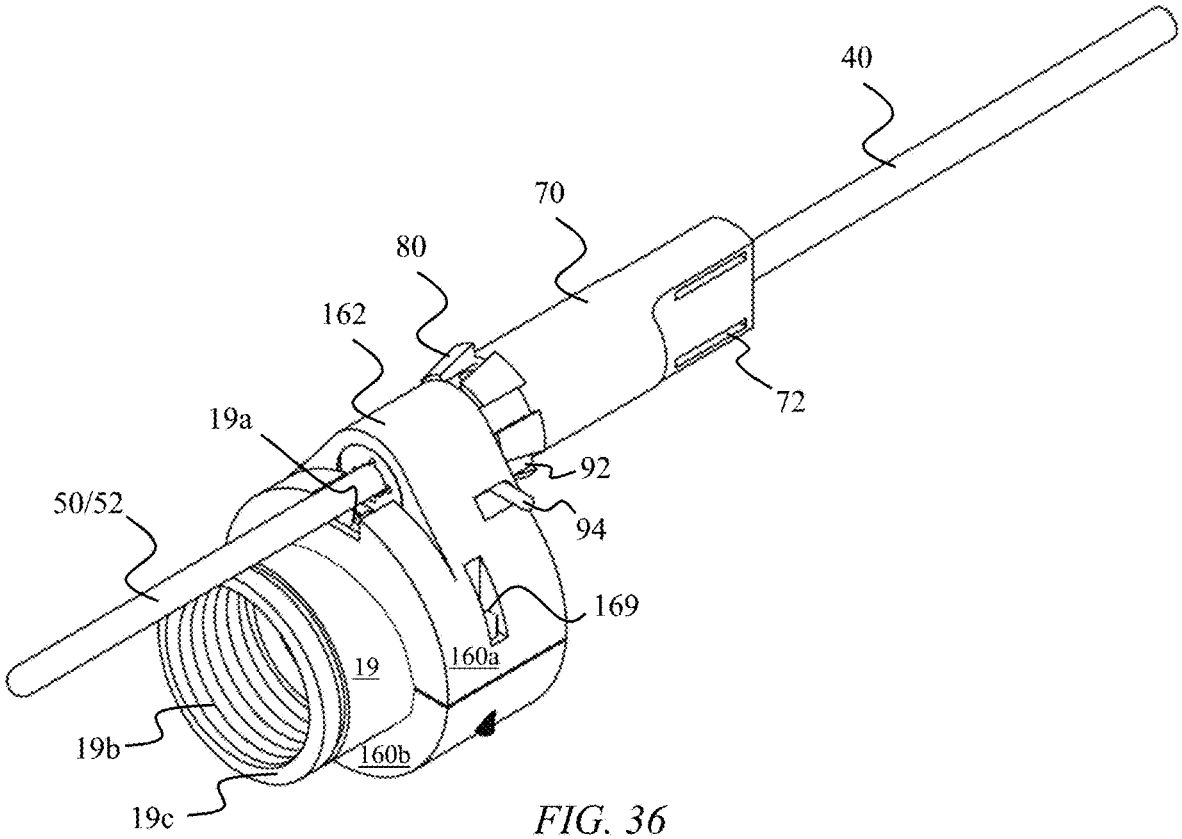
FIG. 36 is a perspective view of the piston mount adapter components with a gas tube, piston, barrel piston cylinder and barrel piston cap installed in the piston mount aperture of the piston mount adapter. The piston mount adapter is further shown mounted on a conventional barrel nut.

FIG. 36 shows a piston mount adapter 160 mounted on a conventional barrel nut 19. A barrel piston assembly is mounted on the piston mount 162 of the piston mount adapter 160. The barrel piston assembly includes a gas tube 40, a piston 50, barrel piston cylinder 80, and a barrel piston cap 70. A first end (proximal end) of barrel piston cylinder 80 is inserted into the aperture 164 (see FIG. 34) of piston mount 162. Insertion of barrel piston cylinder 80 into the aperture 164 of piston mount 162 is limited by barrel cylinder castle 84. A second end (distal end) of barrel piston cylinder 80 is inserted into, and threadingly engages complimentary threads, within barrel piston cap 70. The piston operating rod 52 of the piston 50 extends through an aperture 86 (see FIG. 21) in barrel piston cylinder 80. Piston mount 162 has piston slot 165 cut along the axis of the piston rod 50 to allow for proper alignment and clearance of the piston operating rod 52. An actuator 94 on the spring-loaded piston lock 90 (see e.g. FIG. 26) is inserted through the piston lock slot 66, with the piston lock slot 166 defining the fore-aft motion of the piston lock 90. Piston lock pin 92 sits within a castle slot 85 (See e.g. FIG. 22) in the barrel cylinder castle 84, thus preventing rotation of the barrel piston cylinder 80 during operation of the rifle, which serves to lock the barrel piston cylinder 80. Following the removal of the barrel piston cap 70 and the piston 50 from the barrel piston cylinder 80, the barrel piston cylinder 80 can be removed from the piston mount 62 by first disengaging the piston pin 92 from the castle slot 85. The piston pin 92 can be disengaged by pulling actuator 94 towards the receiver of the rifle. Once unlocked, the barrel piston cylinder 80 can be unscrewed from the piston mount 162 using a spanner wrench engaging the castle slots 85 of the barrel cylinder castle 84. It will generally not be necessary to remove the barrel piston cylinder 80 from the piston mount 162 in the field to service and clean the piston assembly. Simply removing the barrel piston cap 70 and piston 50 will be all that is required to access the piston chamber and clean the piston assembly.

The barrel piston cap 70 has a pair of barrel piston adapter slots 72 designed to receive the end of a flat article such as a screw driver. Insertion of an article within the slots 72 facilitates rotation of the barrel piston cap 70 using the additional leverage applied with the article, which can have the benefit of disengaging the barrel piston cap 70 from the barrel piston cylinder 80, such as when breaking down of the piston assembly for cleaning. Alternatively, a wrench can engage the flattened surfaces 70*a* on opposing sides of the barrel piston cap 70 to disengage the barrel piston cap 70 from the barrel piston cylinder 80. In this manner, the rifle does not require specialized tools to breakdown and clean the piston assembly. In addition, deposits are kept away from the critical components including the bolt and bolt carrier assembly. This is particularly important in the field where access to tools is limited and stress can significantly impact a user's ability to service the rifle. Furthermore, the manner in which the piston components fit together makes their assembly and disassembly less complicated. This can be particularly important in combat situations where the stress of combat may reduce an individual's ability to perform tasks quickly and accurately, such as the precise reassembly of a rifle. Furthermore, having the gas from the spent cartridge directed out prior to re-entering the chamber can significantly reduce deposits in the chamber and extends the life of lubricants applied to bolt and bolt carrier, thereby enhancing the time between servicing those components.

Figure 37:
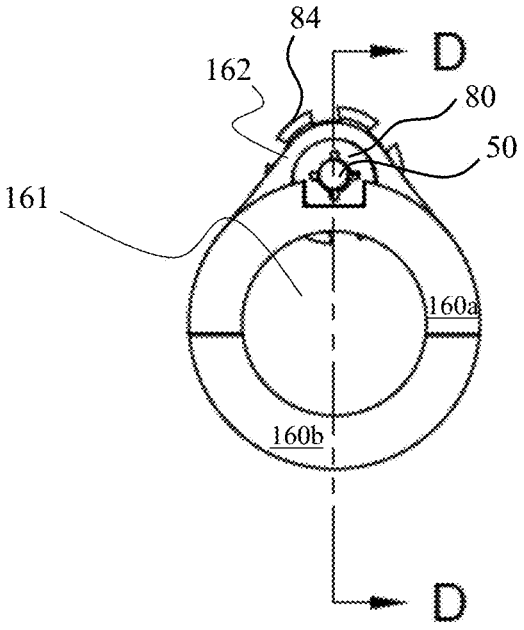
FIG. 37 is a front elevation view of an embodiment of a piston mount adapter with a piston and barrel piston cylinder installed in the piston mount of the piston mount adapter. The axis defined by "D" is the axis upon which the cut-away is presented in FIG. 38.
Figure 38:
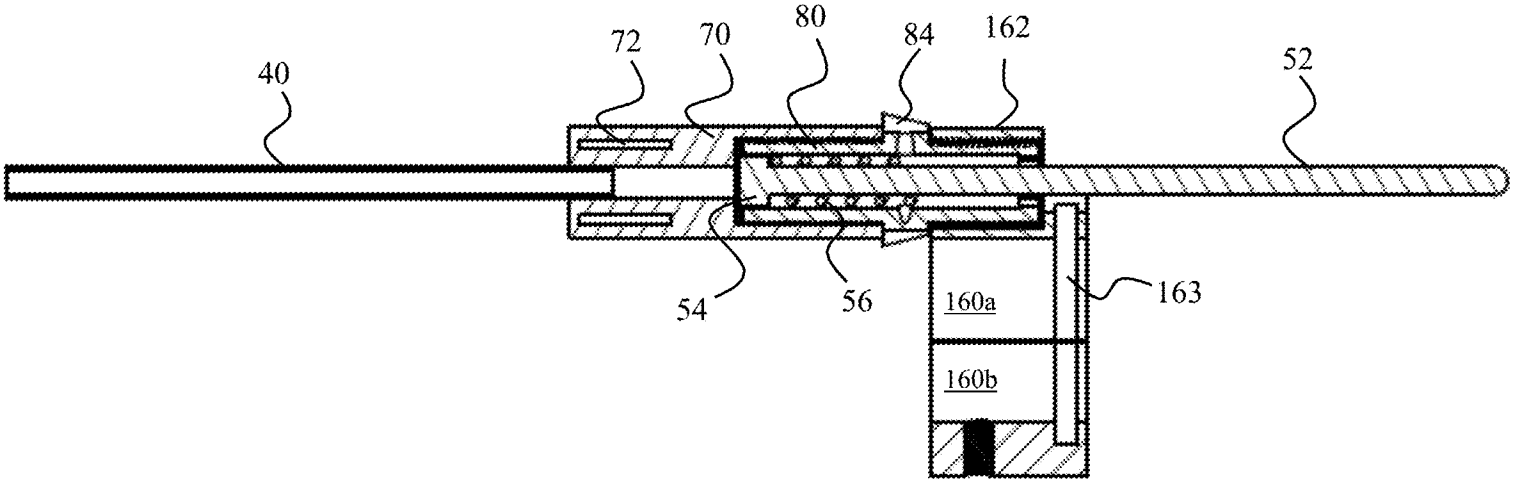
FIG. 38 is a cut-away side elevation view of a piston mount adapter with a gas tube, piston, barrel piston cylinder and barrel piston cap installed in the piston mount of the piston mount adapter. The section was taken along the "D" axis as shown in FIG. 37.

FIG. 37 shows a piston mount adapter 160 as shown in FIG. 31 with a barrel piston cylinder 80 mounted to the piston mount 162. FIG. 38 shows a cut-away view of a piston mount adapter 160 as shown in FIG. 37 with a piston assembly 50 mounted on the piston mount 162 of the piston mount adapter 160. As can be seen in FIG. 38, the barrel piston cylinder 80 is secured to the piston mount 162 using a set of complementary threads. Similarly, the barrel piston cap 70 engages the barrel piston cylinder 80 with a set of complementary threads. The gas tube 40 is slidingly received within a bore in the barrel piston cap 70. The piston assembly, with the piston head 54, the piston rod 52 and the piston spring 56, is secured within the chamber formed by the barrel piston cylinder 80 and the barrel piston cap 70.

Figure 39:
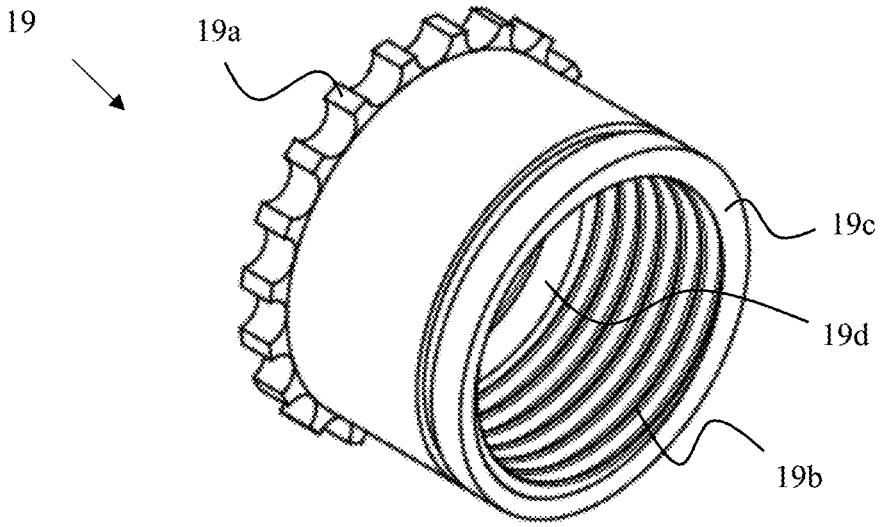
FIG. 39 is a perspective view of a conventional barrel nut.
Figure 40:
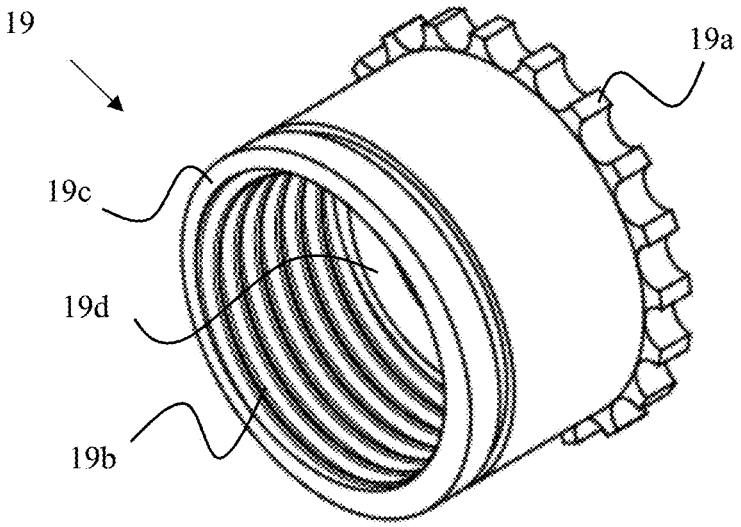
FIG. 40 is a second perspective view of the conventional barrel nut shown in FIG. 39.
Figure 41:
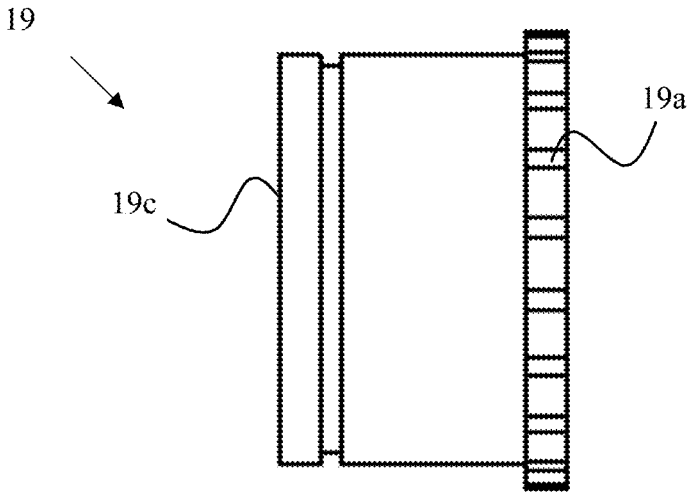
FIG. 41 is a side elevation view of the conventional barrel nut shown in FIG. 39.
Figure 42:
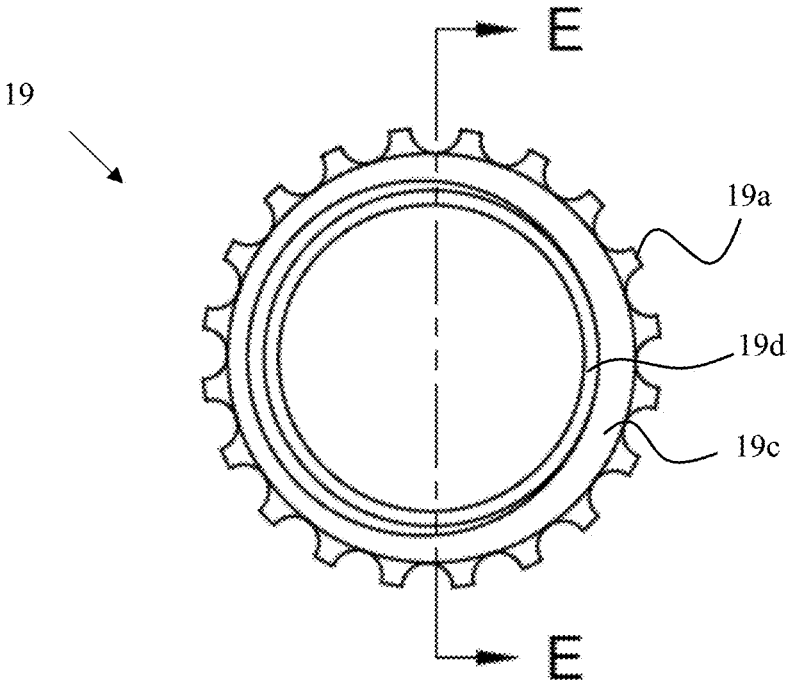
FIG. 42 is a third perspective view of the conventional barrel nut shown in FIG. 39. The axis defined by "E" is the axis upon which the cut-away is presented in FIG. 43.
Figure 43:
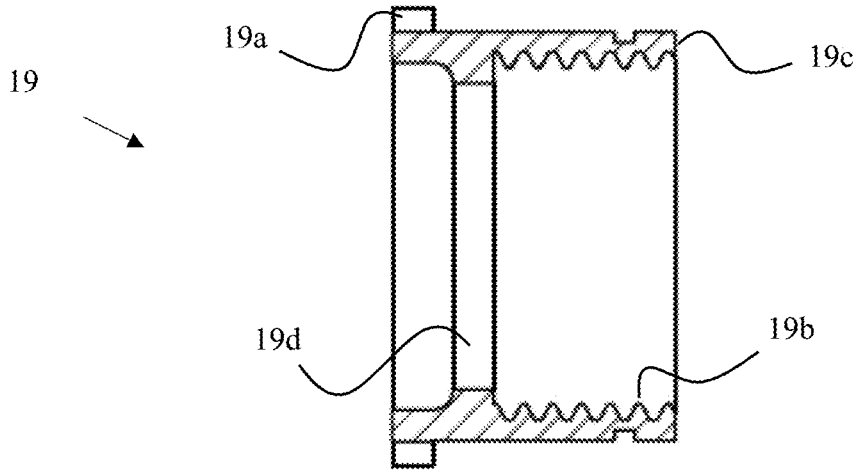
FIG. 43 is a side cut-away view of the conventional barrel nut shown in FIG. 39. The section was taken along the "E" axis as shown in FIG. 42.

FIG. 39 shows a conventional barrel nut 19 with a set of threads 19*b* designed to engage complementary threads on an upper receiver of a rifle and an index 19*a* encircling the outer surface of the barrel nut.

Glossary of Claim Terms

As used throughout the entire application, the terms "a" and "an" are used in the sense that they mean "at least one", "at least a first", "one or more" or "a plurality" of the referenced components or steps, unless the context clearly dictates otherwise.

As used herein, the term "comprising" is intended to mean that the products, compositions and methods include the referenced components or steps, but not excluding others. "Consisting essentially of" when used to define products, compositions and methods, shall mean excluding other components or steps of any essential significance. Thus, a composition consisting essentially of the recited components would not exclude trace contaminants. "Consisting of" shall mean excluding more than trace elements of other components or steps.

The term "and/or" wherever used herein includes the meaning of "and", "or" and "all or any other combination of the elements connected by said term".

The term "about" or "approximately" as used herein means within 20%, preferably within 10%, and more preferably within 5% of a given value or range.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

The terms "distal" and "proximal" are used throughout the specification and claims of the application. The term "proximal" refers to a position closer to the buttstock of the gun and away from the end of the barrel of a gun, while the term "distal" to a position closer to the end of the barrel of a gun of the gun and away from the buttstock of a gun.

All references cited in the present application are incorporated in their entirety herein by reference to the extent not inconsistent herewith.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A gas piston assembly comprising:

a barrel nut having a substantially hollow generally cylindrical shape with an external surface and an internal surface, wherein the internal surface has an engagement member configured to securely engage a receiver of a firearm and wherein the barrel nut comprises a gas piston mount on the external surface of the barrel nut;

a gas piston unit having a first gas piston chamber component integral or affixed to the gas piston mount, a second gas piston chamber component removeably affixed to the first gas piston chamber component, and a piston, wherein the piston has a piston head in a gas piston chamber formed by the first and second gas piston chamber components and a piston rod that engages a bolt carrier key of a bolt carrier group; and a gas tube in communication with a rifle barrel gas port at a first end and the gas piston chamber at a second end.

2. The gas piston assembly according to claim 1 wherein the gas piston mount on the external surface of the barrel nut is distal to the engagement member.

3. The gas piston assembly according to claim 2 wherein the gas piston mount and the engagement member are threaded and the threads of the gas piston mount are distal to the threads on the engagement member.

4. The gas piston assembly according to claim 1 wherein the second gas piston chamber component is removeably affixed to the first gas piston chamber component with a set of complementary threads.

5. The gas piston assembly according to claim 1 wherein the second gas piston chamber component includes a flattened or structured surface configured to be engaged by a wrench to facilitate disengagement of the second gas piston chamber component from the first gas piston chamber component.

6. The gas piston assembly according to claim 1 wherein the second gas piston chamber component includes a slot or channel configured to be engaged by a knife or screwdriver to facilitate disengagement of the second gas piston chamber from the first gas piston chamber.

7. The gas piston assembly according to claim 1 wherein the second gas piston chamber component receives the gas tube through an aperture in the second gas piston chamber component and wherein disengaging the second gas piston chamber component from the first gas piston chamber component allows the second gas piston chamber component to slide up the gas tube towards the first end of the gas tube.

8. The gas piston assembly according to claim 1 wherein the first gas piston chamber component or the second gas piston chamber component includes a gas piston chamber exhaust port positioned within the gas piston chamber to allow exhaust gases to escape the gas piston chamber as the piston head is forced past the gas piston chamber exhaust port by the exhaust gases.

9. The gas piston assembly according to claim 1 wherein the first gas piston chamber component has a gas piston chamber floor and further comprising a piston spring on the piston rod between the piston head and the gas piston chamber floor, whereby the piston spring prevents the piston head from contacting the gas piston chamber floor.

10. The gas piston assembly according to claim 1 further comprising a gas piston chamber lock that prevents disengagement of the first gas piston chamber from the gas piston mount during operation.

11. The gas piston assembly according to claim 10 wherein the gas piston chamber lock is a sliding bolt lock.

12. The gas piston assembly according to claim 1 wherein the first gas piston chamber is removeably affixed to the gas piston mount with a set of complementary threads.

13. A gas piston assembly comprising:

a gas piston mount adapter comprising a gas piston mount and a barrel nut engagement member, wherein the gas piston mount adapter securely affixes to the barrel nut a barrel nut of a rifle;

a gas piston unit having a first gas piston chamber component integral or affixed to the gas piston mount, a second gas piston chamber component removeably affixed to the first gas piston chamber, and a piston, wherein the piston has a piston head in a gas piston chamber formed by the first and second gas piston chamber components and a piston rod that engages a bolt carrier key of a bolt carrier group; and a gas tube in communication with a rifle barrel gas port at a first end and the gas piston chamber at a second end.

14. The gas piston assembly according to claim 13 wherein the second gas piston chamber component is removeably affixed to the first gas piston chamber component with a set of complementary threads.

15. The gas piston assembly according to claim 13 wherein the second gas piston chamber component includes a flattened or structured surface configured to be engaged by a wrench to facilitate the disengagement of the second gas piston chamber component from the first gas piston chamber component.

16. The gas piston assembly according to claim 13 wherein the second gas piston chamber component includes a slot or channel configured to be engaged by a knife or screwdriver to facilitate the disengagement of the second gas piston chamber from the first gas piston chamber.

17. The gas piston assembly according to claim 13 wherein the second gas piston chamber component receives the gas tube through an aperture in the second gas piston chamber component and wherein disengaging the second gas piston chamber component from the first gas piston chamber component allows the second gas piston chamber component to slide up the gas tube towards the first end of the gas tube.

18. The gas piston assembly according to claim 13 wherein the first gas piston chamber component or the second gas piston chamber component includes a gas piston chamber exhaust port positioned within the gas piston chamber to allow exhaust gases to escape the gas piston chamber as the piston head is forced past the gas piston chamber exhaust port by the exhaust gases.

19. The gas piston assembly according to claim 13 further comprising a gas piston chamber lock that prevents the disengagement of the first gas piston chamber from the gas piston mount during operation.

20. The gas piston assembly according to claim 19 wherein gas piston chamber lock is a sliding bolt lock.

21. The gas piston assembly according to claim 13 wherein the first gas piston chamber is removeably affixed to the gas piston mount with a set of complementary threads.

* * * * *